United States Patent [19]

Nakaniwa

[11] Patent Number: 5,050,084

[45] Date of Patent: Sep. 17, 1991

[54] METHOD AND APPARATUS FOR CONTROLLING SUPPLY OF FUEL INTO INTERNAL COMBUSTION ENGINE

[75] Inventor: Shinpei Nakaniwa, Isesaki, Japan

[73] Assignee: Japan Electronic Control Systems Co., Ltd., Isesaki, Japan

[21] Appl. No.: 473,032

[22] Filed: Jan. 31, 1990

[30] Foreign Application Priority Data

Feb. 1, 1989 [JP] Japan ..... 1-20843

[51] Int. Cl.[5] ..... F02D 41/10; F02D 41/34; F02B 3/12

[52] U.S. Cl. ..... 364/431.07; 123/492; 364/431.06

[58] Field of Search ..... 364/431.05, 431.07, 364/431.06; 73/118.2, 119 A; 123/480, 488, 489, 492, 493, 494

[56] References Cited

U.S. PATENT DOCUMENTS

| | | | |
|---|---|---|---|
| 4,583,174 | 4/1986 | Watanabe | 364/431.05 |
| 4,748,447 | 5/1988 | Oshizawa | 73/119 A |
| 4,869,222 | 9/1989 | Klassen | 364/431.05 |
| 4,905,155 | 2/1990 | Kanno | 364/431.05 |
| 4,933,863 | 6/1990 | Okano et al. | 364/431.05 |
| 4,947,816 | 8/1990 | Nakaniwa et al. | 123/422 |
| 4,957,083 | 9/1990 | Nakaniwa et al. | 123/480 |

FOREIGN PATENT DOCUMENTS

| | | |
|---|---|---|
| 57-8328 | 1/1982 | Japan . |
| 1-237333 | 9/1989 | Japan . |

*Primary Examiner*—Felix D. Gruber
*Attorney, Agent, or Firm*—Foley & Lardner

[57] ABSTRACT

In the control of the sequential fuel injection in an internal combustion engine, where the engine load is set based on the opening of the throttle valve and the engine revolution number and the quantity of correction of the fuel supply quantity is determined based on the ratio of the change of this engine load and the time up to a predetermined time during the intake stroke, this time is computed for each cylinder and the correction quantity is set individually for the respective cylinders.

15 Claims, 11 Drawing Sheets

METHOD AND APPARATUS FOR CONTROLLING SUPPLY OF FUEL INTO INTERNAL COMBUSTION ENGINE

BACKGROUND OF THE INVENTION (1) Field of the Invention

The present invention relates to a method and apparatus for controlling the supply of fuel into an internal combustion engine. More particularly, the present invention relates to a fuel supply control method and apparatus of a sequential injection system, in which fuel supply values disposed for respective cylinders are independently actuated at predetermined supply-initiating times and in each cylinder, the supply of a fuel is effected at a time matched to the intake stroke of the cylinder.

(2) Description of the Related Art

As an example of the conventional method and apparatus for controlling the supply of fuel according to a sequential injection system, there is the method and apparatus disclosed in Japanese Unexamined Patent Publication No. 57-8328. The fuel supply control of this sequential injection system is advantageous in that in each cylinder, an air-fuel mixture in which air and fuel are sufficiently mixed can be supplied, there being no dispersion among the cylinders, and the variation of torque can be reduced.

However, the fuel supply control of this sequential injection system involves a problem in that at the transient driving state, a detection delay is caused in an air flow meter for detecting the quantity of intake air or a pressure sensor for detecting the intake pressure or delay of the computation of the fuel supply quantity by the apparatus, and the flow rate of intake air or the intake pressure is changed during the period from the point of the final setting of the fuel supply quantity to the intake stroke where the supplied fuel is practically inputted. Accordingly, for example for acceleration, the fuel supply quantity is set at a level lower than the level corresponding to the actual intake air quantity or intake pressure, and hence, the air-fuel ratio of the intake air-fuel mixture becomes excessively lean and the concentration of hydrocarbon HC or nitrogen oxide $NO_x$ in the exhaust gas is increased or a delay of the response of the average effective pressure by misfire by a lean air-fuel ratio is caused, with the result that an acceleration shock is caused or the acceleration response characteristic is degraded.

With this background, we previously proposed a fuel supply control apparatus in which the change of the state of intake air for transient driving is estimated and the fuel supply quantity is corrected based on the estimated change to improve the precision, of the fuel supply control at the transient driving state (see Japanese Unexamined Patent Publication No. 1-2237333 and U.S. patent application Ser. No. 261,887, now U.S. Pat. No. 4,947,816, patented Aug. 14, 1990).

In correcting the fuel supply quantity based on the estimated change of the state of intake air at the transient driving state, the quantity of the change of the engine load is computed based on the opening of the throttle valve and the engine revolution number, the detection of which is not delayed, and the time from the present point to the point of the predetermined crank angle position at the intake stroke (at the target crank angle position for the fuel supply control) is determined, it is estimated from the present change quantity how the engine load will change until the predetermined crank angle position of the intake stroke where the air-fuel mixture is actually inputted, and while regarding the estimated quantity of the change as corresponding to the excess or shortage of the fuel supply quantity, the normal fuel supply quantity sequentially controlled based on the intake air flow quantity Q or intake pressure PB is corrected.

In the case where the time Xms from the present point to the target crank angle position during the intake stroke (preferably the time at which the intake force is largest during the intake stroke), which is data necessary for the above-mentioned correction control, is increased as the time up to the target crank angle position during the intake stroke in the cylinder where the injection is now to be initiated, every time a reference angle signal REF emitted in the vicinity of the position of the initiation of the sequential injection of each cylinder (#1 to #4) from a crank angle sensor is received, and this time Xms is reduced by a unit time with the lapse of time until receipt of the subsequent reference angle signal REF, that is, in the case where one timer is changed over to a different cylinder every time the reference angle signal REF, for example, if the initial detection of the change of the engine load is performed in the state where the above-mentioned time Xms is changed over to the data of cylinder #3 and the target crank angle position of cylinder #1 where the injection is effected before cylinder #3 is not yet reached, the interrupt injection quantity is set based on the time up to the target crank angle position of cylinder #3 and the ratio of the change of the engine load, and it is impossible to perform the interrupt injection corresponding to the change of the load after the normal injection with respect to cylinder #1.

In the case where the fuel correction value is set based on the above-mentioned time Xms and the ratio of the change of the load of the engine and the fuel quantity for sequential injection is corrected by this fuel correction quantity, supposing that the ratio of the change of the engine load is computed at every 10 milliseconds, if this compution time of 10 milliseconds is just before the sequential injection and the time Xms is changed over to that for the cylinder where the injection of the fuel is going to be performed, the desired correction is made. However, if the compution time comes while the time Xms corresponding to the cylinder where the sequential injection is effected and there is no chance of the computation before the initiation of the next sequential injection, the correction quantity for the cylinder of the previous injection is used for the present sequential injection and the desired correction cannot be made.

In this case, if the period of the reference angle signal REF is added to the time Xms, even if the time Xms is not changed over to that corresponding to the cylinder of the next sequential injection, the time from the present point to the target crank angle position of the cylinder of the next sequential injection can be set, but if the revolution number increases and there is no chance of the computation of the correction quantity during the interval of the initiation of the sequential injection, even if the above-mentioned correction of the time Xms is made, the desired correction cannot be attained.

SUMMARY OF THE INVENTION

The present invention has been completed under the above-mentioned background, and it is a primary object of the present invention to improve the air-fuel ratio control characteristics at the transient driving state of an engine by computing and setting the time up to the target crank angle position in the intake stroke individually for respective cylinders and increasing the precision in the correction control of the fuel supply quantity based on the estimated change of the state of intake air.

Another object of the present invention to improve the precision of the time up to the target crank angle position, computed individually for respective cylinders.

Still another object of the present invention is to immediately supply the correction quantities, set individually for respective cylinders based on the time up to the target crank angle position, immediately to the engine.

According to the present invention, the foregoing objects can be attained by a method for controlling the supply of fuel to an internal combustion engine which is constructed so that the fuel supply quantity is set based on the driving state of the internal combustion engine and fuel supply units disposed for respective cylinders are independently actuated at times matched to the intake strokes of the respective cylinders based on the set fuel supply quantity to supply the fuel to the respective cylinders, said method comprising computing the time up to the target crank angle position for each cylinder, setting the quantity of correction of the fuel injection quantity based on said time computed for the cylinder and the ratio of the change of an engine load parameter, and causing the fuel supply units disposed for the respective cylinders to perform correction operations based on the correction quantities set for the respective cylinders.

In the present invention, it is preferred that the engine load parameter be set based on a variably controlled open area of an intake path system of the engine and a revolution number of the engine.

Furthermore, according to the present invention, the correction operations of the fuel supply units for the respective cylinders, based on the quantity of the correction of the fuel supply quantity, can be performed by correcting the fuel supply control performed at times matched to the intake strokes of the respective cylinders.

Moreover, the fuel supply units for the respective cylinders are actuated to perform the correction operation based on the quantity of the correction of the fuel supply quantity, independently from the fuel supply control conducted at the time matched to the suction stroke in each cylinder.

Still further, in the present invention, it is preferred that there be adopted a construction in which the time up to the target crank angle position in the intake stroke is renewed and set based on the parameter of the revolution number of the engine and the crank angle to the target crank angle position every time the parameter of the engine revolution number is renewed, whereby a chance of the renewal of the time up to the target crank angle position is maintained.

It also is preferred that the target crank angle position be set in the range from the point of 90° after the top dead point of suction to the bottom dead point of suction.

Still further, in the present invention, it is preferred that there be adopted a construction in which in the state of acceleration just after the control for stopping the fuel supply, the ratio of the change of the parameter of the engine load is increase-controlled according to the engine temperature.

Furthermore, in accordance with the present invention, there is provided an apparatus for controlling the supply of fuel to an internal combustion engine, which comprises a fuel supply quantity-determining unit for determining the fuel supply quantity based on the engine driving state including at least the quantity of the state of intake air, which participates in the intake air quantity of the engine detected by an engine driving state-detecting unit, a sequential fuel supply control unit for independently actuating fuel supply unit disposed for respective cylinders at predetermined supply-initiating times based on the determined fuel supply quantity, to perform the normal fuel supply at times matched to the intake strokes of the respective cylinders, an engine load parameter-setting unit for setting a parameter relative to the engine load based on a variably controlled opening area of an intake path system of the engine and a revolution number of the engine, an engine load parameter change quantity-computing unit for computing the quantity of change of an engine load parameter per unit time, a target time-computing unit for computing times up to the target crank angle position in the intake stroke individually for respective cylinders, a correction quantity-setting unit for setting the quantity of correction of the fuel supply quantity individually for the respective cylinders based on the quantity of the change of the engine load parameter and the time set for each cylinder by the target time-computing unit, and a corrected fuel supply control unit for performing at least one step of normal corrected supply control for correcting and setting the fuel supply quantity based on the correction quantity set for each cylinder and causing the sequential fuel supply control unit to perform the normal fuel supply while maintaining the correspondence relation to the cylinders and additional supply control for actuating the fuel supply unit of the corresponding cylinder based on the corrected quantity for each cylinder, independently from the sequential fuel supply control unit.

In the apparatus having the above-mentioned structure, the engine driving state-detecting unit detects the engine driving state including at least the quantity of the state of intake air, which participates in the quantity of air intake in the engine and the fuel supply quantity setting unit sets the fuel supply quantity based on the detected engine driving state.

The sequential fuel supply control unit actuates individual fuel supply units disposed for respective cylinders at the predetermined supply-initiating times based on the fuel supply quantity, to effect normal fuel supply at times matched to the intake strokes of the respective cylinders.

The engine load parameter-setting unit sets a parameter relative to the engine load based on a variably controlled opening area of the intake system of the engine and a revolution number of the engine, and the engine load parameter change quantity-computing unit computes the quantity of the change of the engine load parameter per unit time. The target time-computing unit computes the time up to the target crank angle position in the intake stroke for each cylinder.

The correction quantity-setting unit sets the quantity of correction of the fuel supply quantity for each cylinder based on the computed change quantity of the engine load parameter and the target time for each cylinder.

The corrected fuel supply control unit corrects and sets the fuel supply quantity based on the correction quantity set for each cylinder and performs at least one step of normal corrected supply control for correcting and setting the fuel supply quantity based on the correction quantity set for each cylinder and causing the sequential fuel supply control unit to perform the normal fuel supply while maintaining the correspondence relation to the cylinders and additional supply control for actuating the fuel supply unit of the corresponding cylinder based on the corrected quantity for each cylinder, independently from the sequential fuel supply control unit.

If the correction quantity for each cylinder is computed based on the time up to the target crank angle position, computed for each cylinder, and the quantity of the change of the engine load parameter, by performing at least one step of normal supply correction control of setting an optimum fuel supply quantity for each cylinder by correcting and computing the normal fuel quantity based on this correction quantity and thus conducting the normal fuel injection and additional supply control for actuating the fuel supply control unit of the corresponding cylinder based on the above-mentioned correction quantity independently from the sequential fuel supply control unit, response delay in the fuel supply control at the transient state of the engine where changes of the engine load parameter can be corrected individually for respective cylinders.

In computing the target time for each cylinder, when the target crank angle position is reached in a certain cylinder, the time up to the next crank angle position in this certain cylinder is determined, and this time is reduced with the lapse of time and correction is conducted until the target crank angle position is reached again in this cylinder. If this correction is not made, when the revolution number of the engine changes midway, this cannot be coped with and the precision of the computation of the time is reduced. Accordingly, every time the revolution number of the engine or the parameter of the revolution number of the engine is renewed, the target time for each cylinder is renewed and set based on this renewed value and the crank angle to the target crank angle position for each cylinder, and the target time is corrected based on the newest data of the engine revolution number even in the course of decrease of the target time, whereby the precision of the computation of the target time is improved.

Furthermore, the target crank, angle position should be set at the point where the intake force of the cylinder is strongest in the intake stroke (the state where the intake valve is opened), and the peak generally appears at intake ATDC of 90° in the stationary driving statem and in the accelerated state, this peak approaches intake BDC. Accordingly, the target crank angle position is set between intake ATDC of 90° and intake BDC, whereby the precision of the correction and control is advantageously increased.

In the present invention, if in the additional supply control by the corrected fuel supply unit, there is adopted a structure in which the correction quantity setting unit is cylinder by the correction quantity-setting unit is corrected and set based on the engine temperature, the additional supply can be performed appropriately according to the atomizability of the fuel.

Still further, during additional supply control by the corrected fuel supply unit, if there is adopted a structure in which if a time exceeding the predetermined time has passed from the point of termination of the control of the operation of the fuel supply unit by the sequential fuel supply control unit, the correction quantity set for each cylinder by the correction quantity-setting unit is corrected and set based on the response delay of the fuel supply unit, the response delay of the fuel supply unit is compensated by the additional supply control.

It is preferred that the engine load parameter-setting unit is constructed so that a basic fuel supply quantity be set as the parameter relative to the engine load.

Furthermore, it is preferred that the normal supply correction control in the corrected fuel supply control unit be conducted so that the basic fuel supply quantity in the fuel supply quantity set by the fuel supply quantity-setting unit is corrected.

Moreover, if the engine load parameter change quantity-computing unit is constructed unit is so that in the acceleration state just after the control of stopping the supply of the fuel, the quantity of the change of the engine load parameter is increase-corrected according to the engine temperature, the correction can be made appropriately according to the presence or absence of the control of stopping the supply of fuel.

The present invention will be understood from the following description of an embodiment illustrated in the accompanying drawings. Appropriate changes and modifications can be made to the embodiment without departing from the scope set forth in the claims.

DETAILED DESCRIPTION OF THE PREFERRED EMBODIMENT

Figure 1:
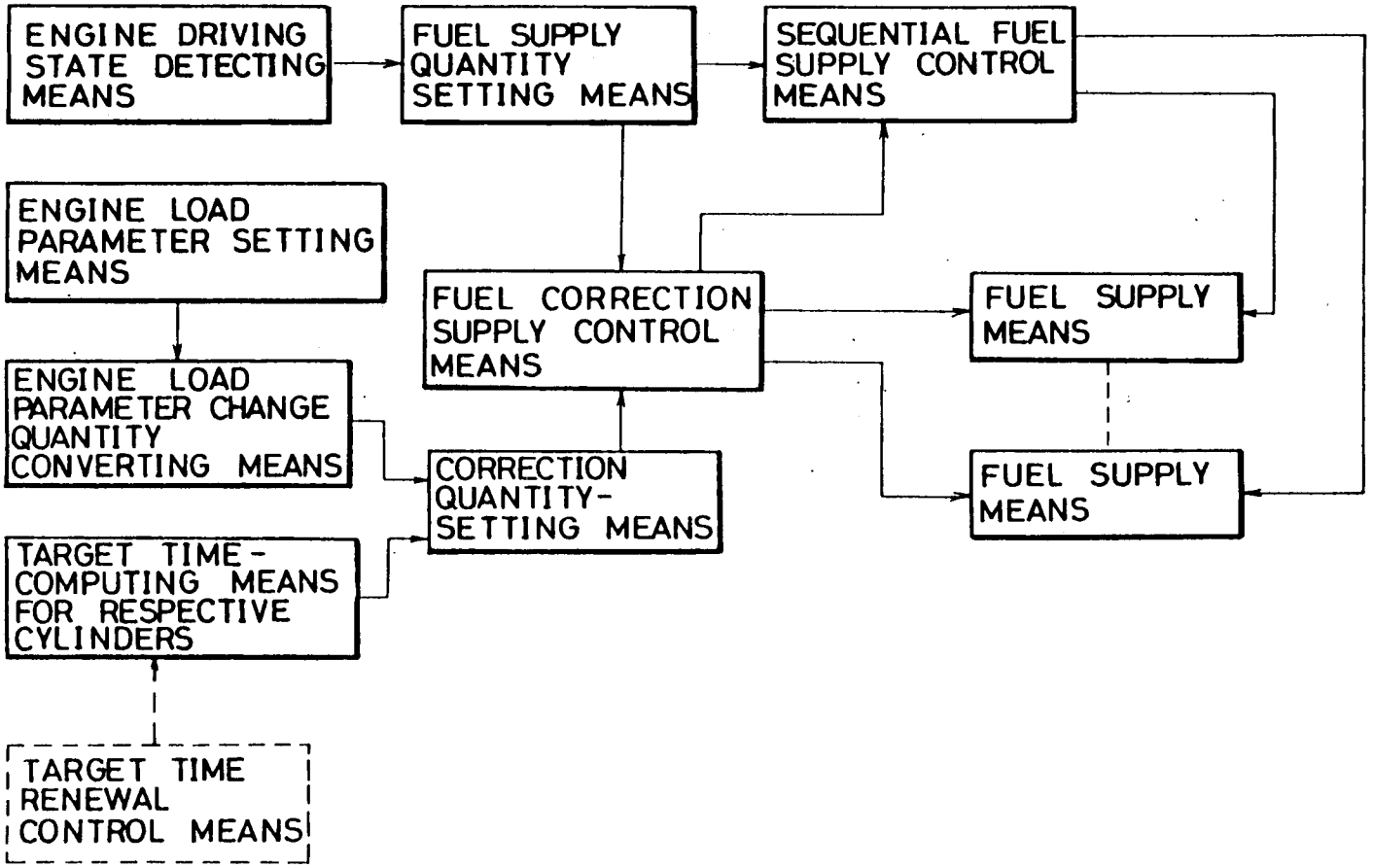
FIG. 1 is a block diagram illustrating the outline of the structure of the present invention.

The outline of the present invention is illustrated in FIG. 1, and an embodiment of the present invention is illustrated in FIGS. 2 through 10.

Figure 2:
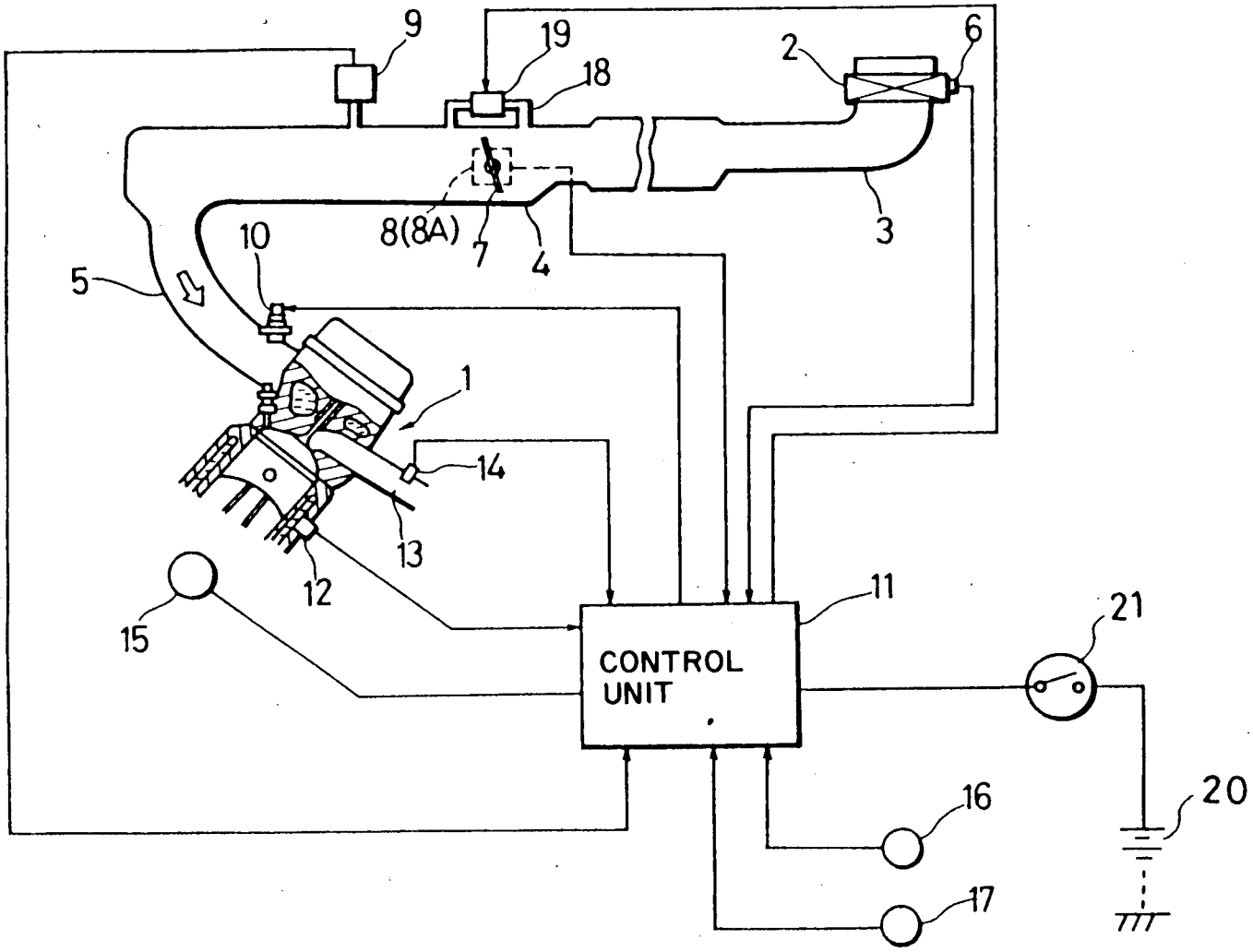
FIG. 2 is a system diagram illustrating one embodiment of the fuel supply control apparatus in an internal combustion engine according to the present invention.

Referring to FIG. 2 showing the structure of the system of one embodiment of the present invention, air is intake into an internal combustion engine through an air cleaner 2, an intake duct 3, a throttle chamber 4 and an intake manifold 5. An intake air sensor 6 for detecting the temperature TA (°C.) of intake air (open air) is arranged in the air cleaner 2. A throttle valve 7 cooperating with an accelerator pedal, not shown in the drawings, is arranged in the throttle chamber 4 to control the intake air flow quantity Q. A throttle sensor 8 including a potentiometer for detecting the opening TVO of the throttle valve 7 and an idling switch 8A to be turned on at the idling position of the throttle valve 7 are disposed in the throttle valve 7.

An intake pressure sensor 9 for detecting the intake pressure PB and electromagnetic fuel injection valves 10 as fuel supply unit for respective cylinders are arranged in the intake manifold 5 disposed downstream of the throttle valve 7. The fuel injection valves 10 are individually driven and opened by injection pulse signals emitted at times matched to the intake strokes of the respective cylinders synchronously with, for example, ignition times from a control unit 11 in which a microcomputer described hereinafter is arranged, and fuel fed under pressure from a fuel pump, not shown in the drawings, which has the pressure controlled to a predetermined level by a pressure regulator, is injected and supplied into the intake manifold 5. Namely, the quantity of the fuel supplied by the fuel injection valve 10 is controlled by the time of opening of the fuel injection valve 10.

Furthermore, a water temperature sensor 12 for detecting the temperature Tw of cooling water in a cooling jacket of an engine 1 is arranged, and an oxygen sensor 14 for detecting an air-fuel ratio of an intake air-fuel mixture by detecting the oxygen concentration in the exhaust gas in an exhaust path 13 is arranged.

The control unit 11 detects the engine revolution number N by counting crank unit angle signals POS emitted synchronously with the revolution of the engine from a crank angle sensor 15 for a certain time or measuring the period TREF of crank reference angle signals REF emitted at every predetermined crank angle position (at every 180° in case of a four-cylinder engine).

A car speed sensor 16 for detecting the car speed and a neutral sensor 17 for detecting the neutral position are arranged in a transmission attached to the engine 1, and these signals are put into the control unit 11. Moreover, a voltage signal from a battery 20 as the power source for driving and opening the fuel injection valve 10 is put into the control unit 11 through an ignition switch 21. An electromagnetic idling control valve 19 for controlling the idling revolution number through the quantity of auxiliary air is arranged in an auxiliary air path 18 bypassing the throttle valve 7.

The control unit 11 computes the fuel injection quantity Ti (the pulse width of the injection pulse signal) based on various detection signals detected in the above-mentioned manner and performs the control (the sequential injection control) for driving and opening individually the fuel injection valves 10 for the respective cylinders based on the set fuel injection quantity Ti. Furthermore, the control unit 11 performs the feedback control of the idling revolution number to the target idling revolution number by controlling the opening of an idling control valve 19 for the idle driving state detected based on the idling switch 8A and neutral sensor 17.

Various computing processes conducted by the control unit 11 for the fuel control will now be described according to routines shown in flow charts of FIGS. 3 through 9.

In the present embodiment, the fuel supply quantity-setting unit, sequential fuel supply control unit, engine load parameter-setting unit, engine load parameter change quantity-computing unit, correction quantity-setting units, target time-computing unit for respective cylinders, corrected fuel supply control unit and target time renewal control unit are disposed to perform software functions as shown in the flow charts of FIGS. 3 through 9. In the present invention, the intake pressure sensor 9, the crank angle sensor 15 and the like correspond to the engine driving state-detecting unit.

Figures 1, 3:
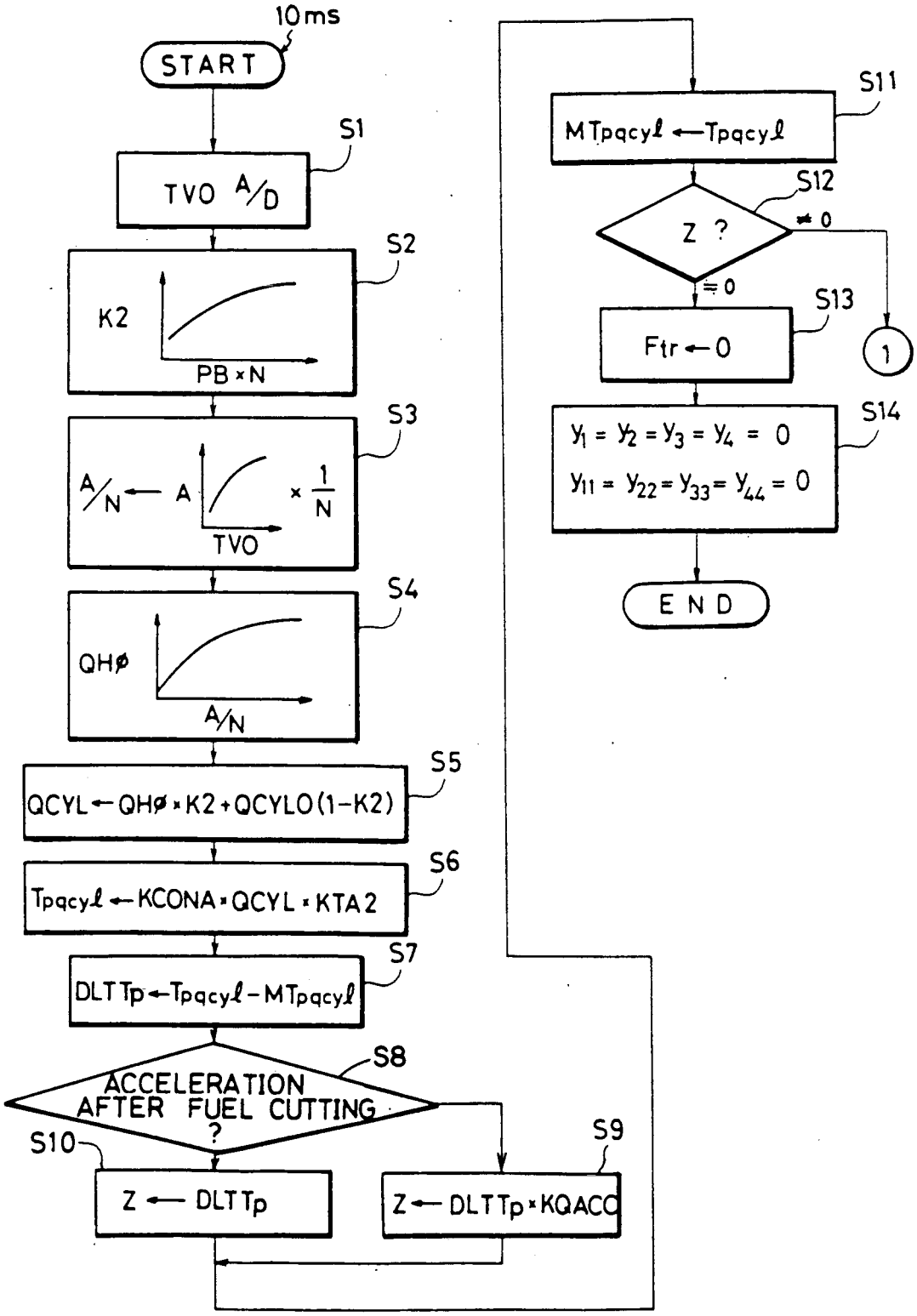
FIGS. 3 through 9 are flow charts showing the contents of the fuel supply control unit the embodiment shown in FIG. 2.
Figures 2, 3:
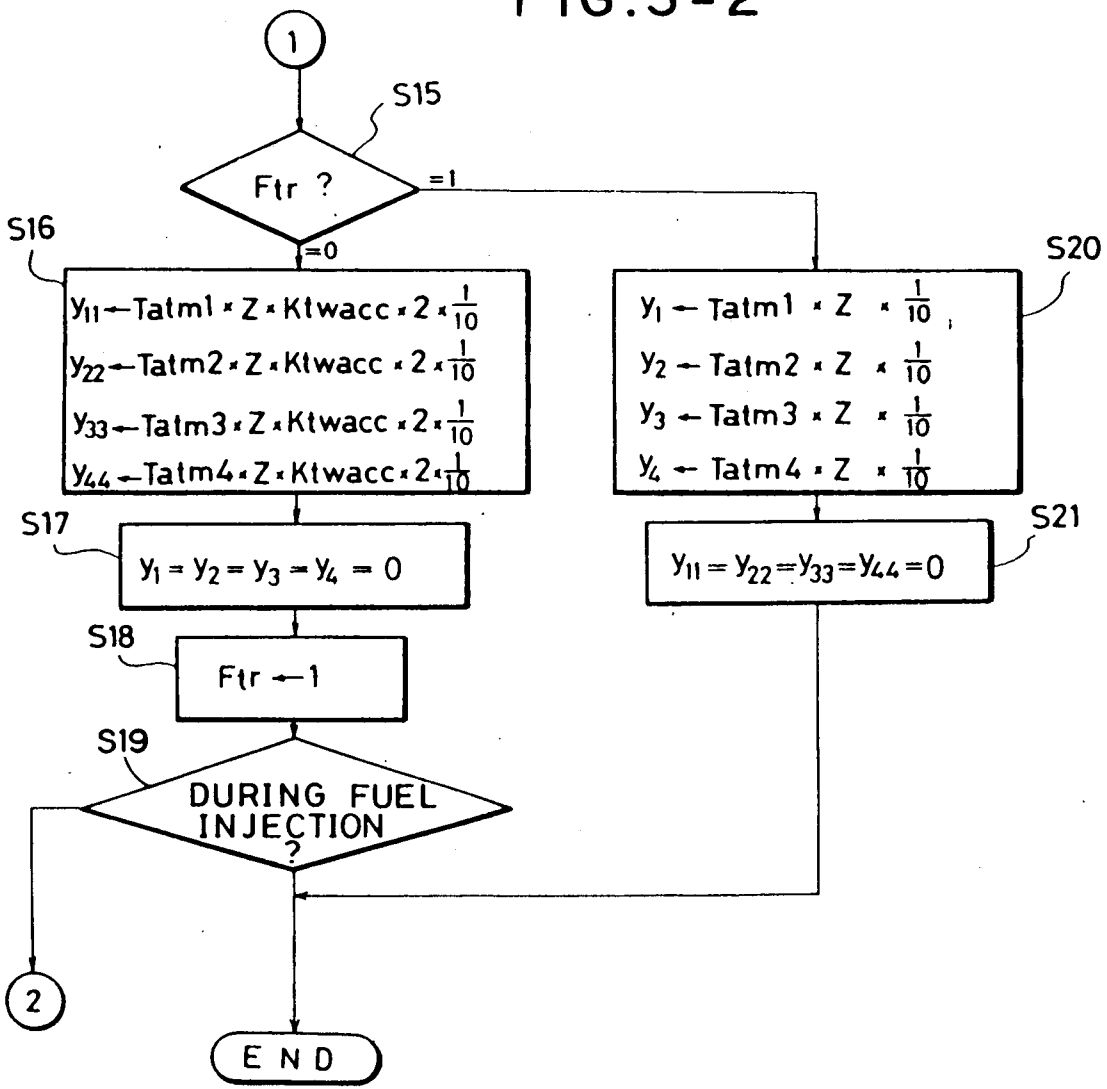
Figure 3:
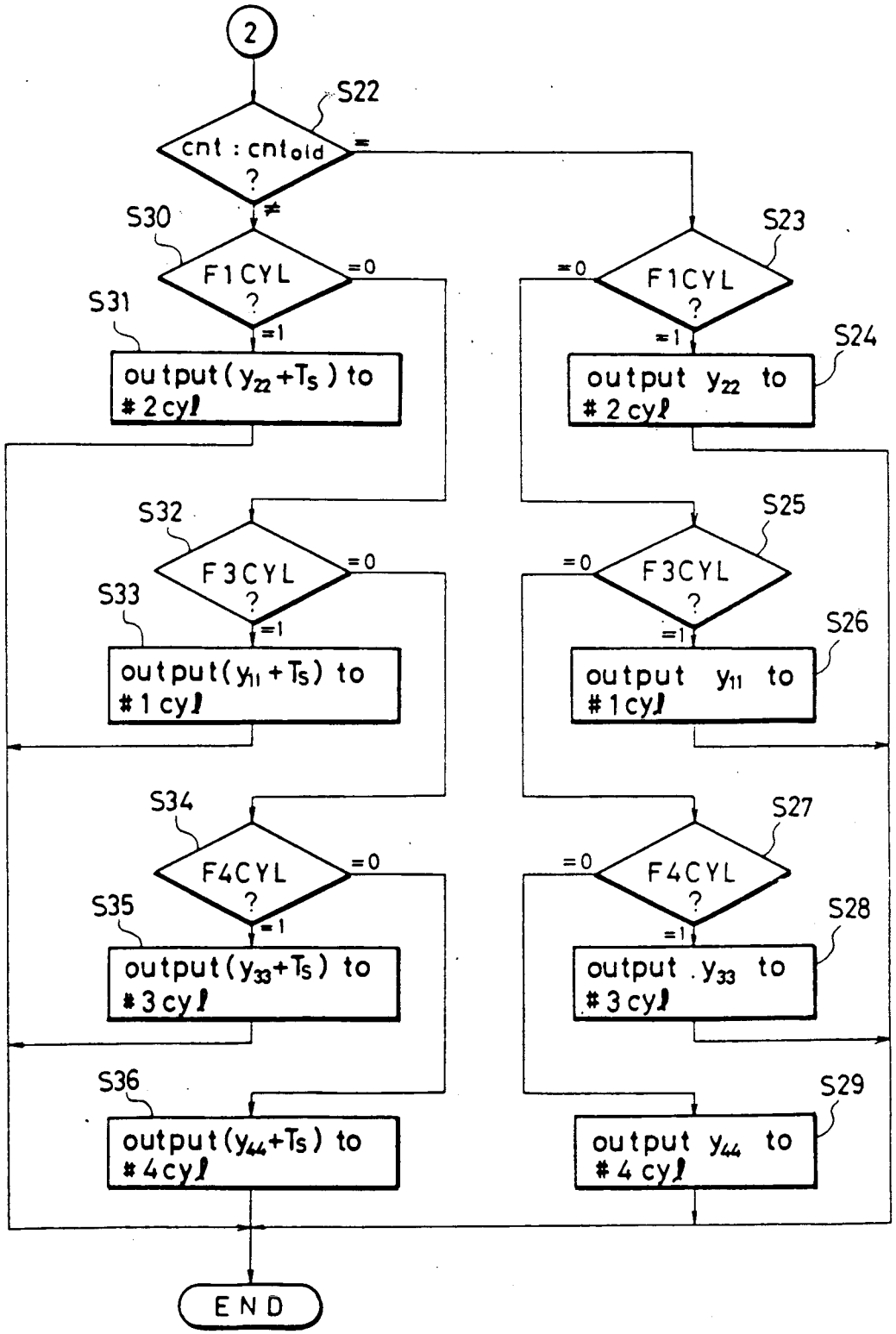

The routine shown in the flow charges of FIGS. 3-1 to 3-3 is conducted at every predetermined short time (for example, 10 milliseconds). At step 1, the opening TVO of the throttle valve 7 detected by the throttle sensor 8 is A/D-converted and put into the routine.

At step 2, a volume efficiency correction factor K2 is retrieved and determined from a preliminarily set map based on the intake pressure PB detected by the product of the intake pressure sensor 9 and the engine revolution number N. As described hereinafter, this volume efficiency correction factor K is a factor for correcting the basic volume efficiency QHϕ determined depending on the opening area A according to the true change of the engine load.

At step 3, the opening area A variably controlled by the throttle valve 7 of the intake system of the engine 1 is retrieved and determined from a map based on the opening TVO of the throttle valve 7, and this opening area A is divided by the engine revolution number N.

At step 4, the basic volume efficiency QHϕ is retrieved and determined from a map based on A/N computed at step 4. Then, at step 5, the final volume efficiency QCYL is computed according to the following formula by using the basic volume efficiency QHϕ retrieved and determined at step 4, the volume efficiency QCYL0 computed at step 5 at the preceding working of the present routine and the volume efficiency correction factor K2 retrieved and determined at step 2:

$$QCYL \leftarrow QH\phi \times K2 + QCYL0(1-K2)$$

If the volume efficiency QCYL is determined according to the above-mentioned computation formula, the relation of QHϕ=QCYL0 is established in the stationary driving state and the volume efficiency QCYL is kept constant. However, in the transient driving state of the engine 1, the change of the volume efficiency QCYL is limited to the value retrieved from the map according to the state of the engine load, whereby the volume efficiency QCYL is set so as to cope substantially with the actual change of the engine load, the detection of which is delayed as compared with the detection of the changes of the opening area A and engine revolution number N, which is not delayed at all.

At step 6, the basic fuel injection quantity Tpqcyl (the engine load parameter) based on the volume efficiency QCYL depending on the opening area A and engine revolution number N is computed according to the formula $Tpqcyl \leftarrow KCONA \times QCYL \times KTA2$. This portion corresponds to the engine load parameter-setting unit. In the above-mentioned formula, KCONA represents a constant, QCYL represents the volume efficiency computed at the above-mentioned step 5, and KTA2 represents an intake temperature (air density) correction factor set by the intake pressure temperature TA (°C.) detected by the intake temperature sensor 6 for the background routine described hereinafter.

At subsequent step 7, the basic fuel injection quantity MTpqcyl computed at step 6 at the preceding working (10 milliseconds before) of the present routine from the basic fuel injection quantity (basic fuel supply quantity) computed at step 6 at the present working to compute the change quantity DLTTp of the basic fuel injection quantity Tpqcyl per working of the present routine (per unit time of 10 milliseconds). This portion corresponds to the engine load parameter change quantity-computing unit.

At subsequent step 8, it is judged whether or not the state is the acceleration state just after the control of stopping the supply of the fuel (fuel cutting). The control of stopping the supply of the fuel is carried out for the purpose of stopping the injection and supply of the fuel by the fuel injection valve 10 at the predetermined deceleration driving of the engine 1 to reduce the amount of the discharged unburnt gas and improve the fuel consumption characteristic.

If it is judged at step 8 that the state is the acceleration state just after the control for stopping the supply of the fuel, the routine goes into step 9, and the change quantity DLTTp determined at step 7 is increase-corrected by multiplying DLTTp by the re-acceleration correction factor KQACC to obtain the final change quantity Z.

The change quantity Z is regarded as indicating the ratio of the change of the fuel quantity demanded by the engine 1 (engine load parameter), and based on this change quantity Z, the interrupt injection quantity (the quantity of the additional injection conducted independently from the normal sequential injection) is set or the correction quantity of the normal fuel injection quantity Ti is set.

At the time of the normal fuel supply, the wall stream (the fuel adhering to the wall surface of the intake path) becomes equilibriated at the quantity corresponding to the engine load at this time, but if the above-mentioned control for stopping the supply of the fuel is performed, the quantity of the wall stream is drastically reduced, as compared with the wall stream quantity during the supply of the fuel. Accordingly, at the time of the acceleration just after the stopping of the fuel supply, it is necessary to perform the fuel control while estimating the ratio of the change of the basic fuel injection quantity Tpqcyl as being larger than in the case of the normal state. At step 9, the increase correction of the change quantity DLTTp is effected so as to satisfy this requirement.

If it is judged at step 8 that the state is not the acceleration state just after the stopping of the supply of the fuel, since the fuel is normally supplied and there is not a drastic change of the wall stream quantity, the routine goes into step 10 and the change quantity DLTTp computed at step 9 is directly set as Z.

At subsequent step 11, the basic fuel injection quantity Tpqcyl computed at step 6 of the present working is set instead of the preceding value MTpqcyl.

Then, at step 12, it is judged whether or not the above-mentioned change quantity Z is zero. If it is judged that the above-mentioned change quantity Z is zero, the engine 1 can be regarded as being in the stationary driving state. In this case, the routine goes into step 13, and the value of zero indicating the stationary driving state is set at a transient flag Ftr. Furthermore, in the state where the stationary driving state of engine 1 is thus judged, at subsequent step 14, all of the interrupt injection quantities y11 through y44 and normal injection correction quantities y1 through y4 corresponding to the respective cylinders (the engine 1 in this embodiment is a 4-cylinder engine and each affix indicates the cylinder number) are set at zero so that correction control of the fuel supply quantity at the transient driving state according to the change quantity Z is not performed. The above-mentioned interrupt injection quantities y11 through y44 and normal injection correction quantities y1 through y4 correspond to the quantity of the correction of the normal fuel supply quantity in the present embodiment.

More specifically, when the engine 1 is in the normal driving state, since quantity of the fuel demanded by the engine 1 (the quantity of air input to the cylinder) is substantially constant, the fuel injection quantity Ti set at the predetermined fuel injection time according to the driving state of the engine not being substantially different from the true fuel quantity demanded by the engine, which appears in the intake stroke after the initiation of the injection, even if there is a detection delay in any of the various sensors, and fuel in a quantity corresponding to the fuel quantity demanded by the engine can be injected and supplied even if there is a time difference between the time of the initiation of the injection (final setting of the fuel injection quantity) and the time of the appearance of the true fuel quantity demanded by the engine. Accordingly, all of the interrupt injection quantities y11 through y44 and normal injection correction quantities y1 through y4 are set at zero and the correction control of the fuel supply quantity corresponding to the above-mentioned time difference is not carried out.

On the other hand, if it if judged at step 12 that the change quantity Z is not substantially zero, the state is the transient driving state in which there is a change of the basic fuel injection quantity Tpqcyl and a response delay of the fuel supply control is caused by the time difference between the time of the initiation of the injection and the time of the appearance of the true fuel quantity demanded by the engine. Accordingly, the routine goes into step 15 and subsequent steps corresponding to the correction quantity-setting unit, and the interrupt injection quantities y11 through y44 and normal injection correction quantities y1 through y4 are controlled and set.

More specifically, in the transient driving state of the engine where the quantity of intake air is increased or decreased, a difference between the quantity of intake air at the predetermined time of the initiation of the injection of fuel and the quantity of intake air, which appears in the intake stroke after the initiation of the injection and corresponds to the true quantity of the fuel demanded by the engine, is produced with a lapse of time. Accordingly, the change (excess or shortage of the fuel supply quantity) of the demanded fuel quantity corresponding to the above-mentioned difference is estimated based on the change of the basic fuel injection quantity Tpqcyl during 10 milliseconds, that is, the value Z, and the response delay of the fuel supply control in the transient driving state including the state of low acceleration or deceleration is eliminated.

At step 15, it is judged whether the transient flag Ftr is at zero or at 1. Since the transient flag Ftr is set at zero at step 13 for the stationary driving state of the engine 1 where the change quantity is judged to be substantially zero at step 12, at the first shift to the transient driving state from the stationary driving state, it is judged at step 15 that the transient flag Ftr is set at zero.

At the first judgement of the transient driving state, the interrupt injection quantities y11 through y44 for respective cylinders (#1cyl to #4cyl) (the quantities of the additional fuel injected in an interrupted manner between normal sequential injections) are computed at step 16 according to the following formulae:

$$y11 \leftarrow Tatm1 \times Z \times 1/10 \times Ktwacc \times 2,$$

$y22 \leftarrow Tatm2 \times Z \times 1/10 \times Ktwacc \times 2$, $y33 \leftarrow Tatm3 \times Z \times 1/10 \times Ktwacc \times 2$, and $y44 \leftarrow Tatm4 \times Z \times 1/10 \times Ktwacc \times 2$.

In the above computation formulae, each of Tatm1 through Tatm4 represents the target time (milliseconds) for each cylinder, which is the time up to the target time for setting the fuel supply quantity for each cylinder from the present point. Incidentally, the target time is the target crank angle position in the intake stroke, where the intake air quantity corresponding to the true demanded quantity appears, and in the present embodiment, the target time is set at intake BDC.

Furthermore, Ktwacc represents a water temperature correction factor set according to the cooling water temperature Tw detected by the water temperature sensor 12, which represents the engine temperature. At the first judgement of the transient state (acceleration), the above-mentioned interrupt injection quantities y11 through y44 for the fuel are injected and supplied independently from the ordinary fuel injection and supply. Accordingly, if the above-mentioned correction is not carried out according to the water temperature Tw, a desired quantity of the fuel cannot be input to the cylinders in the cold state because of changes of the quantity of the fuel adhering to the cylinder wall.

The change quantity Z is the quantity of the change of the basic fuel injection quantity Tpqcyl during the working period of the present routine, that is, 10 milliseconds. Each of Tatm1 through Tatm4 is the time up to the target time, expressed in milliseconds. Accordingly, the change quantity Z can be converted to the change quantity per millisecond by multiplying Z by 1/10.

In the fuel supply control apparatus of the present embodiment, for facilitating computation, the normal fuel injection quantity Ti is computed by doubling the basic fuel injection quantity Tppb based on the intake pressure PB as described hereinafter. Therefore, doubling is effected in computing the above injection quantities.

However, if the state is the deceleration state where the change quantity Z (change quantity DLTTp) is a negative value and if the demanded correction is on the negative side, the interrupt injection quantities y11 through y44 are set at zero or the interrupt injection quantities y11 through y44 are computed as negative values, so that interrupt injection is not practically performed.

The thus-computed interrupt injection quantities y11 through y44 are used to estimate and set the changes of the basic fuel injection quantity Tpqcyl during the period from the present point to the target time for the respective cylinders, that is, the quantities of changes during the period from the present point to the target time of the fuel quantity demanded by the engine for the respective cylinders. Accordingly, in the cylinder where the normal fuel injection has been terminated or in the cylinder where the normal fuel injection is being carried out, from the present point the fuel injection quantity is made insufficient by the accerelation driving state of engine 1 by the quantity corresponding to any of the injection quantities y11 through y44.

After the injection quantities y11 through y44 are set at step 16, the normal injection correction quantities y1 through y4 are set at zero at next step 17. Namely, at the first judgement of the transient state (judgement of acceleration) for the engine 1, the response delay of the fuel supply by the acceleration is compensated by the interrupt injection (additional supply control), but the control (normal supply correction control) for adding the correction of the above-mentioned response delay to the fuel injection quantity Ti in the normal sequence is not performed.

At the next step 18, the transient flag Ftr 1 set at 1 on receipt of the judgement of the transident state made at step 12 of the present routine, and the continuation of the transient driving state is judged by this transient flag Ftr.

At step 19, it is judged whether or not the normal fuel injection is carried out in any of the cylinders, and when the normal fuel injection is carried out in any cylinder, the present routine is terminated without perfoming the interrupt injection control. When the normal fuel injection is not carried out in any of the cylinders, the routine goes into step 22 and subsequent step for interrupt-injecting the fuel in a quantity corresponding to any of the injection quantities y11 through y44 to the cylinder where the normal fuel injection has just been terminated. Step 22 and the subsequent steps correspond to the additional supply control in the corrected fuel supply control unit.

If it is judged at step 15 that the transient flag Ftr is set at 1, this means a state of continuous judgement of the transient driving state where the judgement of the transient state besed on the change quantity Z has been made at step 12 and the flag Ftr has been set at step 18 in the preceding routine. Accordingly, the response delay of the fuel supply control is not compensated for by the interrupt injection or the collection of the response delay is added to the normal fuel injection quantity Ti. Accordingly, in this case, the routine goes into step 20, and the normal injection correction quantities y1 through y4 to be used for the increase or decrease correction of the normal fuel injection quantity Ti are computed according to the following formulae:

$y1 \leftarrow Tatm1 \times Z \times 1/10$, $y2 \leftarrow Tatm2 \times Z \times 1/10$, $y3 \leftarrow Tatm3 \times Z \times 1/10$, and $y4 \leftarrow Tatm4 \times Z \times 1/10$.

In the above formulae, Tatm1 through Tatm4 represent the times (milliseconds) up to the target times for setting the quantities of fuel to be supplied to the respective cylinders, which are the same as the times used for the computation of the interrupt injection quantities y11 through y44. By multiplying these times Tatm1 through Tatm4 by $Z \times 1/10$. which is the change quantity of the basic fuel injection quantity Tpqcyl per millisecond, the changes of the demanded fuel quantities during the time from the present point to the target time are estimated and set for the respective cylinders.

However, in the computation of the normal injection correction quantities y1 through y4, the temperature correction factor Ktwacc used in the computation of the interrupt injection quantities y11 through y44 is not used and furthermore, doubling is not effected. The reason for this is that as described hereinafter, the normal injection correction quantities y1 through y4 are added to the basic fuel injection quantity Tppb computed based on the intake pressure PB and the results of the addition are doubled, and the final injection quantity Ti is computed by further making the correction based on the cooling water temperature Tw.

Incidentally, the normal injection correction quantities y1 through y4 computed according to the above-mentioned computation formulae are positive values for acceleration of the engine 1 and the normal injection quantity is increase-corrected, but for deceleration of the engine 1, they are negative values and the normal injection quantity is decrease-corrected.

When the normal injection quantities y1 through y4 are computed at step 20, all of the interrupt injection quantities y11 through y44 are set at zero at the next step 21. Accordingly, during the continuation of the transient state of the engine 1, the fuel injection conducted at the normal time, not the interrupt injection, is corrected based on the normal injection correction quantities y1 through y4, whereby the correction coping with the response delay of the fuel control at the transient driving is effected.

Referring to step 19 again, at the first judgement of the transient driving (acceleration), the interrupt injection quantities y11 through y44 are computed and set, and it is judged at step 19 whether or not there is a cylinder in which the normal fuel injection is carried out at the present point. If it is judged at step 19 that there is not a cylinder in which the normal fuel injection is carried out, the routine goes into step 22 and it is judged whether or not a predetermined time (for example, 1 millisecond) or more has passed at the present point from the normal fuel injection, and based on the result of this judgement, it is judged whether or not the voltage correction portion Ts for correcting the invalid injection quantity by the operation delay of the fuel injection valve 10 according to the battery voltage should be added to the interrupt injection quantity y11 through y44.

More specifically, in carrying out the interrupt injection for coping with the response delay by the transient driving state, if the elapsed time is within a predetermined time, corresponding to the delay time of the operation of closing the fuel injection valve 10 (a time shorter than the time from the point of turning off the driving pulse signal to the point of the actual full closing of the fuel injection valve 10), from the point of the control of closing the fuel injection valve (the point of turning off the driving pulse signal) in the normal fuel injection, the interrupt injection is performed subsequently to the normal fuel injection, and therefore, the correction by the voltage correction portion Ts for coping with the delay of the valve-opening operation is not carried out, a desired quantity of the fuel can be interrupt-injected, and the voltage correction portion Ts becomes an excessive correction.

In constant operation, if the elapsed time exceeds the above-mentioned predetermined time from the point of the termination of the normal fuel injection, the fuel injection valve 10 is opened under the same condition as in the normal sequential injection (the state where the fuel injection valve 10 is fully closed), and if the correction by the voltage correction portion Ts for compensating for the operation delay is not performed, even if an interrupt injection-generating pulse having a pulse width corresponding to the injection quantities y11 through y44 is provided, only fuel in an amount smaller than the set quantity is practically interrupt-injected.

Whether or not the present point is within the predetermined time from the termination of the normal fuel injection control is judged, as described hereinafter, by comparing the count value cnt, which is increased by one at every 1 millisecond, with the value cntold, which is the count value cnt at the time Tiend of the termination of the normal injection control (at thc time when the driving pulse signal is turned off). The count value cnt is increased by 1 at every 1 millisecond as mentioned above. Accordingly, the fact that cnt is not equal to cutold means that a difference of at least 1 is present between them and at least 1 millisecond has passed from Tiend.

Accordingly, if the relation of cnt=cutold is judged at step 22, since the present point is the time Tiend of the termination of the normal injection or only a time shorter than 1 millisecond has passed from the termination time Tiend, the routine goes into step 23 and subsequent steps, interrupt injection is controlled without adding the voltage correction portion Ts to the interrupt injection quantities y11 through y44. On the other hand, if the relation of cnt≠cntold is judged at step 22, since a time of at least 1 millisecond has passed from the time Tiend of the termination of the normal injection, the routine goes into step 30 and subsequent steps, and the interrupt injection quantity is controlled by adding the voltage correction portion Ts to the interrupt injection quantities y11 through y44.

At the interrupt injection time in the first judgement of the transient state, in the case where a time longer than the predetermined time, corresponding to the operation delay of the fuel injection valve 10, has passed from the point of the termination of the normal fuel injection control and it is necessary to perform the opening control of the fuel injection valve under the same conditions as in the normal fuel injection control, if the correction coping with the operation delay of the fuel injection valve 10 is performed by adding the voltage correction portion Ts, as described above, the fuel can be practically interrupt-injected and supplied in amounts corresponding to the set interrupt injection quantities y11 through y44 with a high degree of precision based on the target timings Tatm1 through Tatm4 and the change quantity Z, and the actual interrupt injection supply is not made insufficient by the operation delay of the fuel injection valve 10.

In the case where the interrupt injection is carried out subsequently to the normal fuel injection within a predetermined time from the termination of the normal fuel injection control, the increase correction by addition of the voltage correction portion Ts is not necessary, and if the voltage correction portion Ts is added, the practical supply quantity becomes larger than the set quantity. Accordingly, the voltage correction portion Ts is not added and the interrupt injection of an excessive quantity of fuel is prevented.

The interrupt injection control conducted subsequently to the normal fuel injection without the addition of the voltage correction portion Ts will now be described. At step 23, it is judged whether the flag F1CYL for judging the injection of the cylinder #1 is at 1 or zero. If the flag F1CYL for judging the injection of the cylinder #1 is at 1, it means that the cylinder in which the fuel injection is to be effected at the next predetermined time is the cylinder #1, and when the flag F1CYL for judging the injection of the cylinder #1 is set at 1, the flags F2CYL through F4CYL for judging the fuel injection in the cylinders #2 through #4, described below, are set at zero. Incidentally, setting of the flags F1CYL through F4CYL for judging the injection in the cylinders #1 through #4 will be described in detail hereinafter.

In the four-cylinder engine 1 of the present embodiment, the fuel injection is carried out in the order of #1cyl→#3cyl→#4cyl→#2cyl at every 180° of the crank angle. Accordingly, when the flag F1CYL for judging the injection of the cylinder #1 is set at 1, the cylinder #2 is in the state where the normal injection has been terminated. Therefore, if it is judged at step 23 that the flag F1CYL is set at 1, the routine goes into step 24, and the interrupt injection into the cylinder #2 is carried out. More specifically, at step 24, a driving pulse signal having a pulse width corresponding to the interrupt injection quantity y22 is emitted to the fuel injection valve 10 disposed in the cylinder #2 and the interrupt injection corresponding to the correction of the response delay of the fuel control is carried out in the cylinder #2 subsequently to the normal fuel injection, and the normal fuel injection quantity and the interrupt injection quantity y22 for compensating the response delay are inputted to the cylinder #2 at the latest intake stroke.

The interrupt injection effected for the cylinder #2 in the above-mentioned manner is performed according to the quantity of the change of the demanded fuel quantity within the period from the point just after the normal injection in the cylinder #2 to the predetermined time in the intake stroke of the cylinder #2. By this interrupt injection, fuel in an amount corresponding to the response delay for acceleration is additionally injected to the cylinder #2 where the normal sequential fuel injection has been terminated, and the reduction of the concentration of the air-fuel ratio by the response delay of the fuel control in the initial stage of acceleration can be prevented.

If there is adopted a structure in which in the first judgement of acceleration, at the next time of the initiation of the fuel injection the normal injection quantity is corrected so as to compensate the response delay, the correction compensating the response delay cannot be performed in the cylinder where the fuel injection has already been initiated at the first judgement. Therefore, by injecting the fuel for compensating the response delay in the latest intake stroke independently from the normal injection of the fuel in the above-mentioned manner, the reduction of the concentration of the air-fuel mixture at the initial stage of acceleration can be effectively prevented.

If it is judged at step 23 that the flag F1CYL is at zero, the routine goes into step 25, and it is judged whether the flag F3CYL for judging the fuel injection in the cylinder #3 is at 1 or zero. Similarly, if the flag F3CYL is at 1, the routine goes into step 26 and the interrupt injection compensating the response delay of the fuel control is conducted for the cylinder #3 subsequently to the normal sequential fuel injection.

If it is judged at step 25 that the flag F3CYL is at zero, the routine goes into step 27 and it is judged whether the flag F4CYL for judging the fuel injection in the cylinder #4 is at 1 or zero. If the flag F4CYL is at 1, the interrupt injection of the fuel in an amount corresponding to the interrupt injection quantity y33 is effected on the cylinder #3 at step 28.

If it is judged at step 27 that the flag F4CYL is at zero, since the remaining flag F2CYL for judging the fuel injection in the cylinder #2 should be at 1, the routine goes into step 29, the interrupt injection of the fuel in an amount corresponding to the interrupt injection quantity y44 is effected on the cylinder #4.

As described above, at the first judgement of the transient driving state and within the predetermined time from the point of the termination of the normal fuel injection, the interrupt injection of fuel in an amount corresponding to the interrupt injection quantity y11, y22, y33 or y44 set for the corresponding cylinder is effected for the corresponding cylinder in which the normal fuel injection has just been terminated.

In contrast, when the relation of cnt≠cntold is judged at step 22, the voltage correction portion Ts is not added to the interrupt injection quantities y11 through y44, as described hereinbefore, fuel in an amount corresponding to the interrupt injection quantities y11 through y44 is not supplied, interrupt injection-causing pulse signals having pulse widths corresponding to the values obtained by adding the voltage correction portion Ts to the respective interrupt injection quantities y11 through y44 are emitted to the fuel injection valves 10 disposed in the respective cylinders, and the judgement of the cylinder for the interrupt injection and other judgements are the same as those conducted when the relation of cut=cntold is judged at step 22.

At first, at step 30, it is judged whether the flag F1CYL for judging the fuel injection in the cylinder #1 is at 1 or zero. If the flag F1CYL is at 1, since the normal fuel injection in the cylinder #2 has been terminated and the supply of the fuel to the subsequent cylinder #1 is prepared for, the routine goes into step 31 and an interrupt injection-causing pulse signal having a pulse width corresponding to the value obtained by adding the voltage correction portion Ts to the interrupt injection quantity y22 set for the cylinder #2 is emitted to the fuel injection valve 10 arranged in the cylinder #2.

The computing processes are carried out at step 32 through 36 in the same manner as described above, and the interrupt injection is effected at a pulse width corresponding to the value obtained by adding the voltage correction portion Ts to one of the interrupt injection quantities y11 through y44 for the cylinder in which the normal fuel injection has been terminated.

At the first judgement of the transient driving state and after the passage of a time exceeding the predetermined time from the point of the termination of the normal fuel injection, as in the normal fuel injection, the correction of the operation delay of the fuel injection valve 10 by the voltage correction portion Ts is carried out and interrupt injection is conducted, and fuel in an amount corresponding to the response delay can be additionally injected with a high degree of high precision to the cylinder in which the normal fuel injection has been terminated.

In the case where any of the cylinders is in the state of the normal fuel injection at the first judgement of the transient driving state in the routine shown in the flow chart shown in FIG. 3, the routine is terminated without performing the interrupt injection. In this case, according to the routine shown in FIG. 4, when the fuel injection is terminated in the above cylinder under the injection (practically, when the driving pulse signal is turned off), the interrupt injection is carried out in the same manner as when the relation of cnt=cntold is judged at step 22. However, this interrupt injection after the termination of the normal injection is carried out only when the normal injection is terminated within 10 milliseconds (the working period of the routine shown in the flow chart of FIG. 3) from the point of the first judgement of the transient driving state, and if the normal injection is not terminated within this period, the correction control of the next normal injection based on the normal injection correction quantities y1 through y4 is carried out instead.

Figure 4:
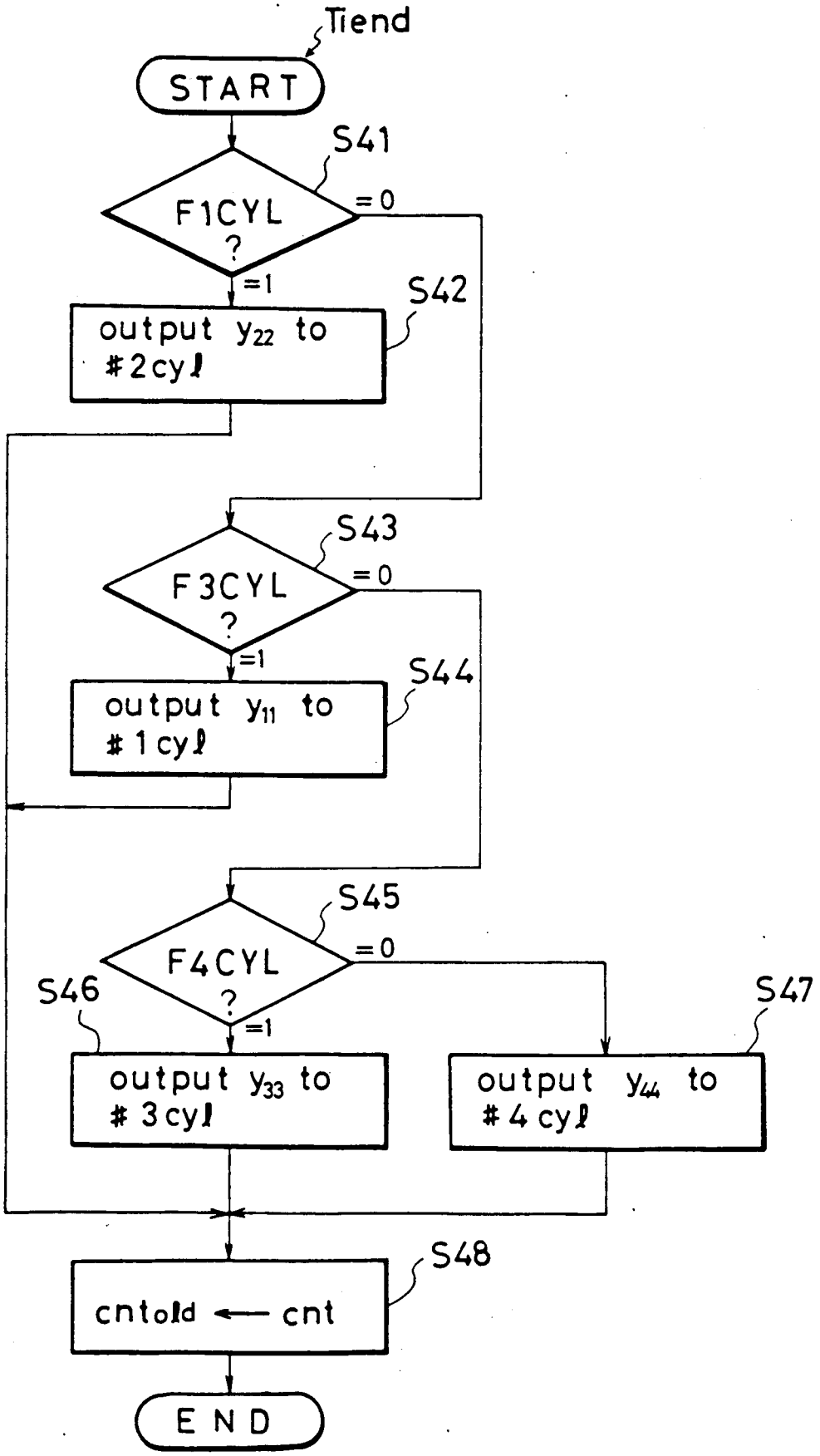

The routine shown in the flow chart of FIG. 4 is routine when the valve-closing driving control is indicated by any of driving pulse signals emitted for the respective fuel injection valves 10. At first, it is judged at step 41 whether the flag F1CYL for judging the injection in the cylinder #1 is at 1 or zero. In the case where it is judged that the flag F1CYL is at 1, the engine is in the state where the fuel is to be injected and supplied to the cylinder #1 at the next injection time, and it is indicated that turn-off of the present driving signal is the fuel supply control for the cylinder #2. Accordingly, if it is judged at step 41 that the flag F1CYL is at 1, the routine goes into step 42, and at step 42, an injection-causing driving pulse signal having a pulse width corresponding to the interrupt injection quantity y22 is emitted to the fuel injection valve 10 of the cylinder #2.

Since the control of this interrupt injection is the same as conducted at steps 23 through 29 described hereinbefore, the description of the subsequent steps 43 through 47 is omitted.

In employing the present routine, when the interrupt injection control to the cylinder where the normal fuel injection has been terminated is completed, at step 48, the present value of the count value cnt to be increased by 1 at every 1 millisecond is set at cntold so that the above-mentioned judgement at step 22 can be carried out based on this cntold.

Incidentally, in the case where the transient driving state of the engine 1 is continued and the normal injection correction quantities y1 through y4 are set step 20 while the interrupt injection quantities y11 through y44 are set at zero at step 21, the interrupt injection according to the present routine is not performed. Also in the case where the stationary driving state of the engine 1 is judged based on the change quantity Z at step 12, the interrupt injection according to the routine of FIG. 4 is not carried out.

Setting and control of the fuel injection quantity (fuel supply quantity) Ti used for the normal fuel injection control (sequential fuel supply control) conducted at times matched to the intake strokes of the respective cylinders according to tho routine shown in the flow chart of FIG. 5 will now be described. This routine corresponds to the fuel supply quantity-setting unit means and the normal supply correction control of the corrected fuel supply control unit.

Figure 5:
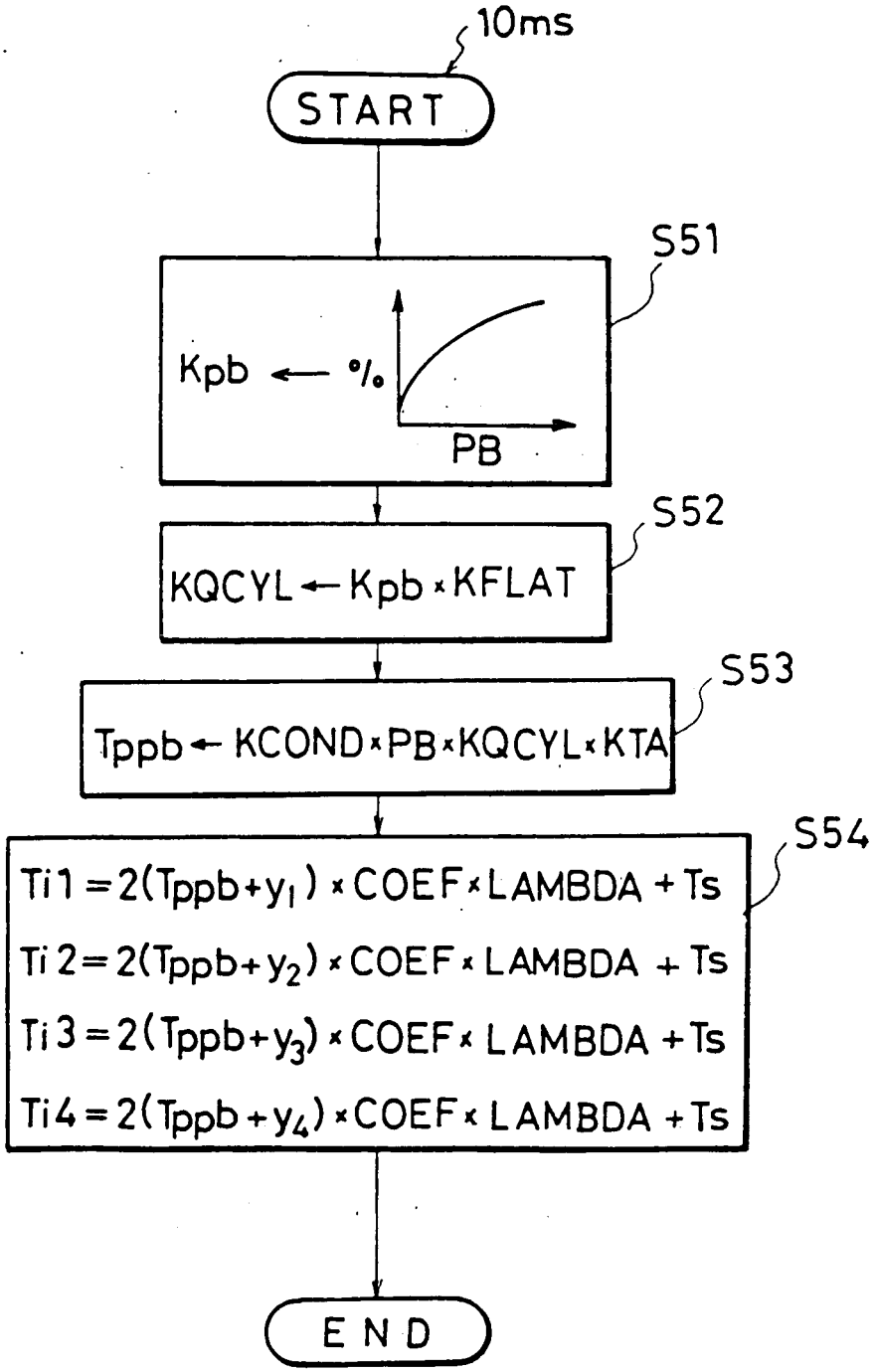

The routine shown in the flow chart of FIG. 5 is employed for a very short time of about 10 milliseconds. At step 51, the basic volume efficiency correction factor Kpb is retrieved and determined from a preliminarily set map based on the intake pressure PB detected by the intake pressure sensor 9.

At step 52, the basic volume efficiency correction factor Kpb retrieved from the map at step 51 is multiplied by the minute correction factor KFLAT set by the background job described hereinafter to compute the final volume correction factor KQCYL (←Kpb×KFLAT).

At next step 53, the basic fuel injection quantity Tppb based on the intake pressure PB is computed according to the following formula:

$$Tppb \leftarrow KCOND \times PB \times KQCYL \times KTA$$

wherein KCOND is a constant, PB represents the intake pressure detected by the intake pressure sensor 9, KQCYL represents the volume efficiency correction coefficient set at step 52, and KTA is an intake temperature correction factor set based on the intake temperature TA by the background job described hereinafter.

At next step 54, the fuel injection quantities Ti1 through Ti4 for the respective cylinders are computed according to the following formulae:

$$Ti1 \leftarrow 2(Tppb + y1) \times COEF \times LAMBDA + Ts,$$

$$Ti2 \leftarrow 2(Tppb + y2) \times COEF \times LAMBDA + Ts,$$

$$Ti3 \leftarrow 2(Tppb + y3) \times COEF \times LAMBDA + Ts, \text{ and}$$

$$Ti4 \leftarrow 2(Tppb + y4) \times COEF \times LAMBDA + Ts.$$

In the above-mentioned formulae, Tppb represents the basic fuel injection quantity computed based on the intake pressure PB at step 53, y1 through y4 represent the normal injection correction quantities for the respective cylinders, computed at step 20 of the flow chart of FIG. 3, COEF represents various correction coefficients set according to the driving state of the engine, represented mainly by the cooling water temperature Tw detected by the water temperature sensor 12, LAMBDA represents the feedback correction factor for approaching the air-fuel ratio in the air-fuel mixture, detected through the oxygen sensor 14, to the target air-fuel ratio, and Ts represents the voltage correction portion corresponding to the operation delay of the fuel injection valve 10, which is the same as the above-mentioned voltage correction portion used for the control of the interrupt injection. By addition of this voltage correction portion, the desired quantity of fuel can be injected and supplied even if the time of the operation delay of the fuel injection valve 10 is changed according to the battery voltage.

If the normal injection quantities y1 through y4 are added to the basic fuel injection quantity Tppb in the above-mentioned manner, even if at the transient driving state of the engine 1, there is generated a difference between the fuel quantity demanded by the engine 1 at the predetermined injection time (the time of emitting the driving pulse signal to the fuel injection valve 10) and the true demanded quantity in the intake stroke, this difference is estimated based on the above-mentioned normal injection quantities y1 through y4, and increase correction is performed for acceleration and decrease correction is performed for deceleration, whereby the response delay in the fuel supply control can be compensated for.

Figure 6:
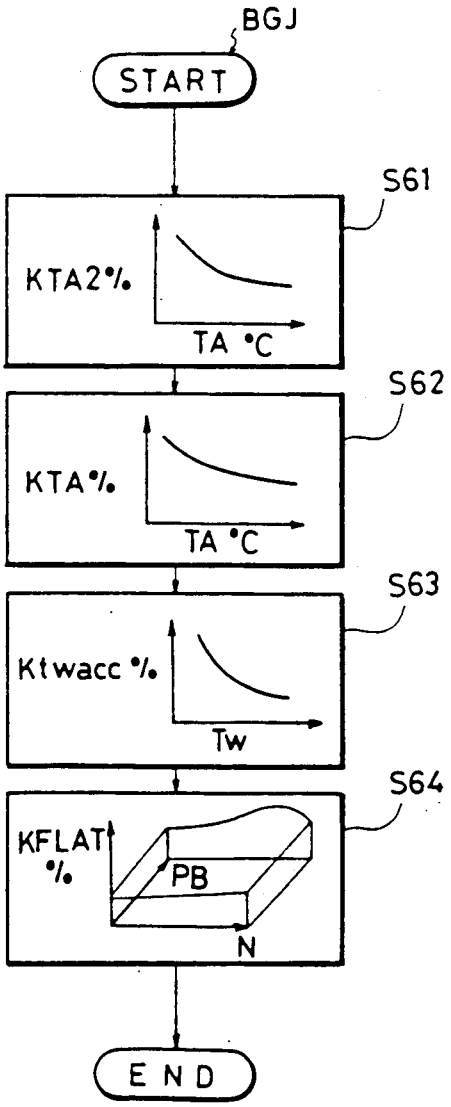

Setting and control of various factors and coefficients will now be described with reference to the background job (BGL) shown in the flow chart of FIG. 6.

At step 61, the intake temperature correction factor KTA2 is retrieved and determined from a map preliminarily set based on the intake temperature TS (°C.) detected by the intake temperature sensor 6. This intake temperature correction factor KTA2 is used for the computation of the basic fuel injection quantity Tpqcyl at step 6.

At step 62, the intake temperature correction factor KTA is retrieved in the same manner, but this intake temperature correction factor KTA is used for the computation of the basic fuel injection quantity Tppb at step 53.

At next step 63, the water temperature correction factor KTwacc is retrieved and determined from the map preliminarily set based on the cooling water temperature Tw detected by the water temperature sensor 12. This water temperature correction factor Ktwacc is used for the computation of the interrupt injection quantities y11 through y44 at step 16.

At next step 64, the minute correction factor KFLAT is retrieved and determined from the map preliminarily set based on the intake pressure PB detected by the intake pressure sensor 9 and the engine revolution number N computed based on the detection signal from the crank angle sensor 15. This minute correction factor KFLAT is used for the correction computation of the basic volume efficiency correction factor Kpb at step 52.

Figure 7:
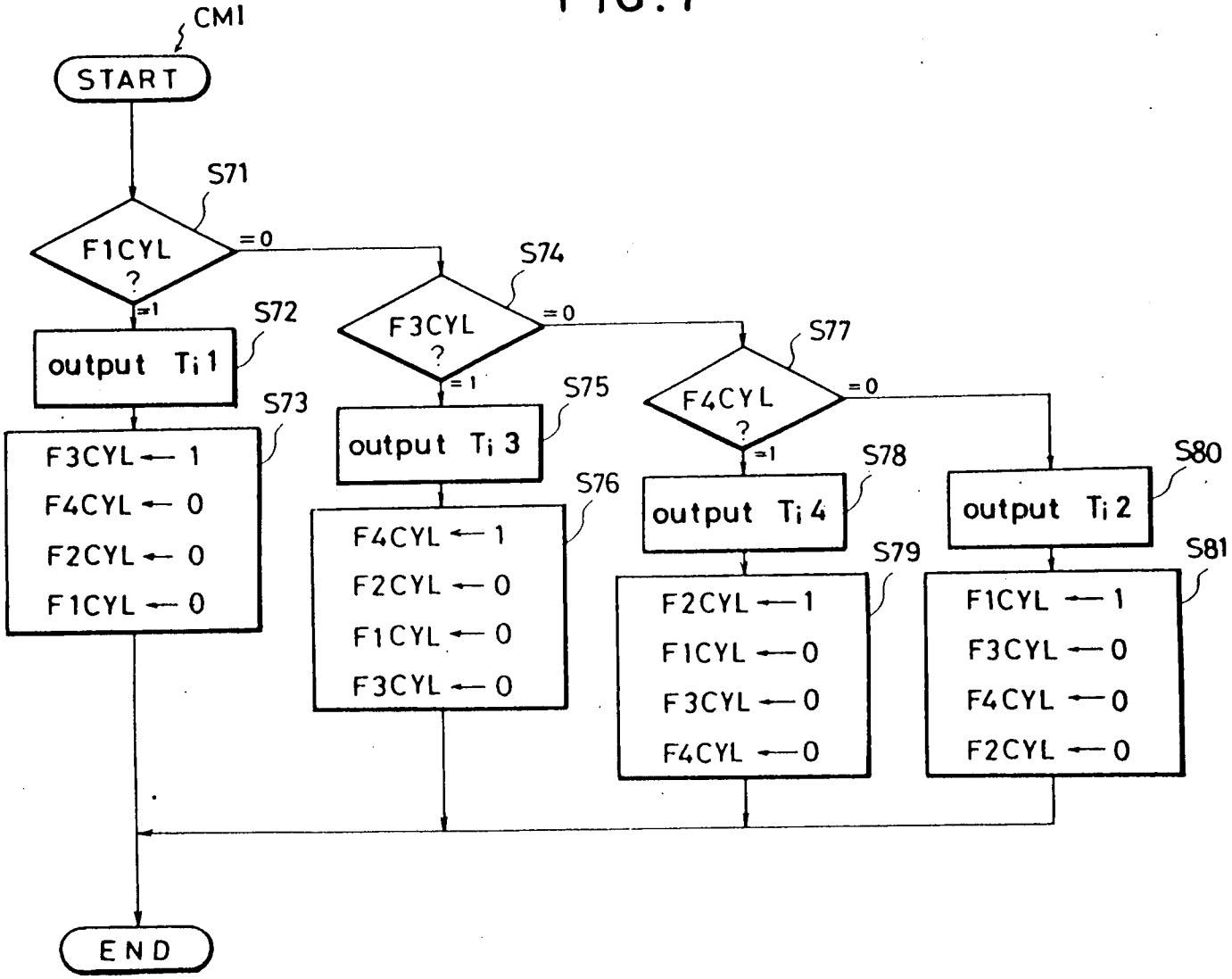

Setting control of flags F1CYL through F4CYL for judging the injection in the cylinders #1 through #4 and normal fuel injection control (the control of outputs of driving pulse signals emitted in the sequential injection control, which corresponds to the sequential fuel supply control means) will now be described with reference to the routine shown in the flow chart of FIG. 7.

In the present embodiment, the fuel injection initiation time is variably controlled based on the fuel injection quantities Ti1 through Ti4 computed for the respective cylinders so that the termination of the normal fuel injection is matched to the time of the opening of the intake valve in each cylinder. However, there can be adopted a structure in which the normal fuel injection is initiated at a certain crank angle position.

This routine is employed when the predetermined fuel injection time (injection-initiating time) is judged based on the detection signal emitted from the crank angle sensor 15. At step 71, it is judged whether the flag F1CYL for judging the injection in the cylinder #1 is at 1 or zero.

As described above, the flag F1CYL for judging the injection in the cylinder #1 indicates the time of initiating the injection in the cylinder #2 and this flag F1CyL is set at 1 when the emission of the driving pulse signal having a pulse width corresponding to the fuel injection quantity Ti2 set for the cylinder #2 is started. Accordingly, in the case where it is judged at this step that the flag F1CYL is at 1, it can be judged that it is time for the injection to the cylinder #1 in which the fuel injection is to be effected after thc cylinder #2. Therefore, when is is judged that the flag F1CYL is at 1, the routine goes into step 72, and the emission of the driving pulse signal having a pulse width corresponding to the fuel injection quantity Ti1 set for the cylinder #1 to the fuel injection valve 10 of the cylinder #1 is started.

At the step 73, the flag F3CYL for judging the injection in the cylinder #3 is set at 1, and all of the other flags F1CYL, F2CYL and F4CYl are set at zero.

If the flag F3CYL is thus set at 1 at the time of the injection of fuel to the cylinder #1, when the present routine is then employed at the injection time and it is judged at step 71 that the flag F1CYL is at zero, the routine goes into step 74. In this case, since it is judged at this step 74 that the flag F3CYL is at 1, the routine goes into step 75 from step 74. At step 75, the driving pulse signal having a pulse width corresponding to the fuel injection quantity Ti3 set for the cylinder #3 at step 54 is emitted to the fuel injection valve 10 arranged in the cylinder #3. At next step 76, F4CYL is set at 1.

Similarly, if it is judged at step 77 that the flag F4CYL is at 1, at step 78 the driving pulse signal corresponding to Ti4 is emitted to the cylinder #4 and at step 79 the flag F2CYL is set at 1. Furthermore, if it is judged at step 77 that the flag F4CYL is at zero, the driving pulse signal corresponding to Ti2 is emitted to the cylinder #2 at step 80 and the flag F1CYL is set at 1 at step 81.

As is apparent from the foregoing description, when the injection time is arrived at and the driving pulse signal is emitted to the corresponding cylinder where the injection is to be effected, of the foregoing flags F1CYL through F4CYL, only the flag corresponding to the cylinder where the injection is to be effected is set at 1, all of the other flags corresponding to the cylinders where the fuel injection is not effected are set at zero, and it is judged that the cylinder having the flag set at 1 is the cylinder in which the fuel injection is to be effected at the injection time.

Setting and control of Tatm1 through Tatm4 indicating the times (milliseconds) up to the target times (predetermined times in the intake strokes where the intake air quantity corresponds to the true demanded quantity) of the fuel supply quantities set for the respective cylinders will now be described with reference to the routine shown in the flow chart of FIG. 8. The routine shown in the flow chart of FIG. 8 corresponds to the target time-computing unit for the respective cylinders and the target time renewal control unit.

Figure 8:
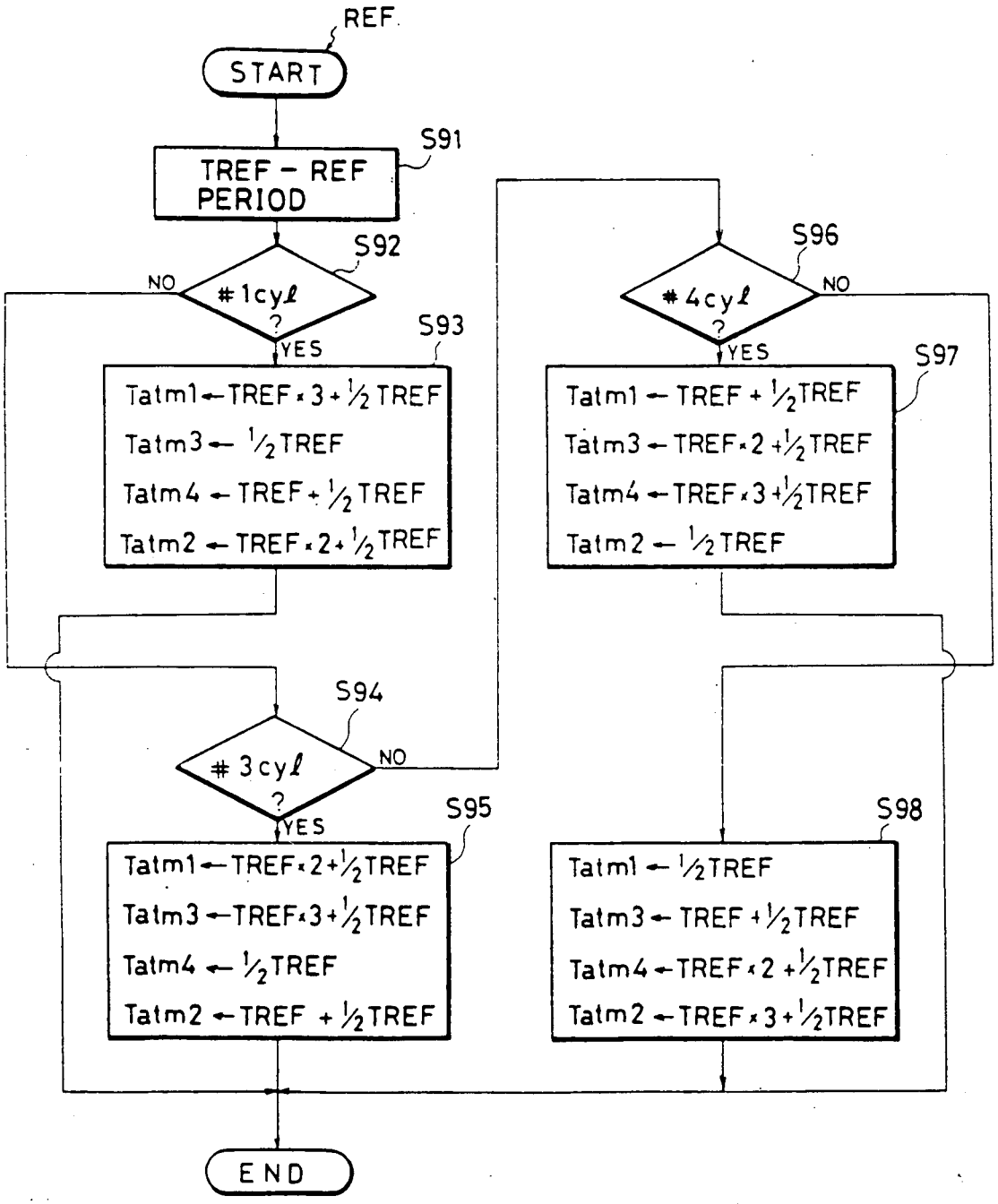

The routine shown in the flow chart of FIG. 8 is employed in case of the four-cylinder engine 1 of the present embodiment every time the reference angle signal REF emitted at every crank crank angle 180° from the crank angle sensor 15 is received. Incidentally, the reference angle signal REF is emitted at an ignition reference position (for example, BTDC 90°) of each cylinder, and the signal corresponding to cylinder #1 is distinguishable from other signals by the reference angle signal REF, the cylinder at the ignition reference position can be discriminated.

When the reference angle signal REF is emitted form the crank angle sensor 15 and the present routine is employed, the period (milliseconds) from the point of the previous emission of the reference angle signal REF to the point of the present emission of the reference angle signal REF is set at TREF. Accordingly, in the present embodiment, the above-mentioned TREF corresponds to the time required for the crank shaft to turn by 180°, and the engine revolution number N can be calculated based on the above-mentioned TREF.

At the next step 92, it is judged whether or not the present reference angle signal REF corresponds to the cylinder #1 (#1cyl) (whether or not the cylinder #1 is at the ignition reference position).

When it is judged that the present reference angle signal REF corresponds to the cylinder #1, the routine goes into step 93, and the target times Tatm1 through Tatm4 are renewed and set according to the following formulae:

$$Tatm1 \leftarrow TREF \times 3 + \tfrac{1}{2}TREF,$$

$$Tatm3 \leftarrow \tfrac{1}{2}TREF,$$

$$Tatm4 \leftarrow TREF + \tfrac{1}{2}TREF, \text{ and}$$

$Tatm2 \leftarrow TREF \times 2 + \frac{1}{2}TREF$.

Since the present reference angle signal REF corresponds to the ignition reference position of the cylinder #1, after the ignition in the cylinder #1, the ignition of the cylinder #3 is effected, and before the ignition of the cylinder #3, intake is effected in the cylinder #3. In the present embodiment, the reference angle signal REF is emitted at the position of intake BTD 90° of each cylinder, and it is supposed that in the intake stroke (the intake valve is open), the predetermined time of the appearance of the intake air quantity corresponding to the true fuel demand is at intake BDC which is the central position between the reference angle signals REF.

Accordingly, the target timing crank angle position (intake BDC of the cylinder #3) set for the cylinder #3 is the position turned 90° from the present reference angle signal REF (intake BTDC of the cylinder #1), and since the time required for 90° turning of the crank shaft is $TREF \times 90°/180°$, the target time Tatm3 for the cylinder #3 is set at $\frac{1}{2}TREF$.

The target time crank angle position of the cylinder #4 which enters into the intake stroke subsequently to the cylinder #3 is behind the target time crank angle position set for the cylinder #3 by 180°, and therefore, Tatm4 is equal to Tatm3+TREF. Similarly, Tatm2 is equal to Tatm3+2×TREF (Tatm4+TREF) and Tatm1 is equal to Tatm3+3×TREF (Tatm+TREF).

Figure 10:
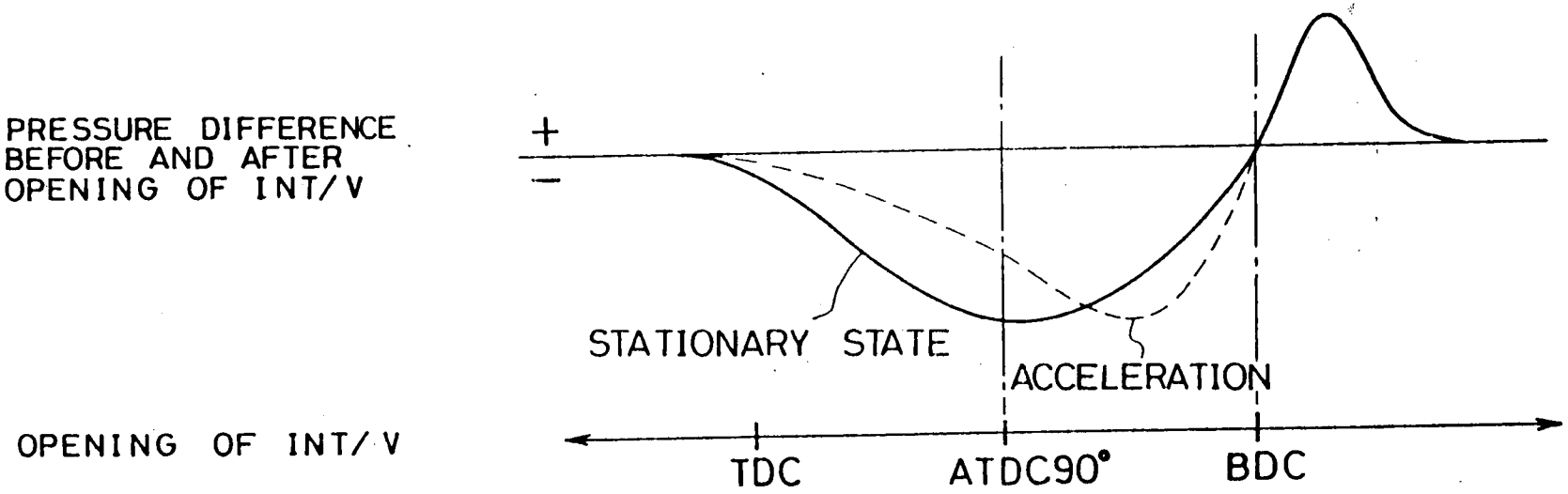
FIG. 10 is a graph illustrating the relation between the time of opening the intake valve and the difference of the pressure before opening the intake valve and the pressure after opening the intake pressure.

Incidentally, in the case where the target time crank angle position for setting the fuel injection is not the central position between the reference angle signals REF, supposing that the crank angle from the reference angle signal REF to the predetermined target time crank angle position is X°, it is sufficient if the relation of $Tatm3 = TREF \times X°/180°$ is established at step 93. However, as shown in FIG. 10, the point at which the pressure difference before and after the intake valve is largest on the intake side and the force of intaking the air-fuel mixture during the period where the intake valve is open is generally in the vicinity of 90° after the top dead point of the intake (intake ATDC 90°) in the stationary state. During acceleration, this point approaches the bottom dead point of the intake (intake BDC). Accordingly, it is preferred that the above-mentioned time crank angle position be set between intake ATDC 90° and intake BDC.

If it is judged at step 92 that the present reference angle signal REF does not correspond to the ignition reference position of the cylinder #1, the routine goes into step 94. At step 94, it is judged whether or not the present reference angle signal REF corresponds to the ignition reference position of the cylinder #3. If it is judged that REF corresponds to the ignition reference position of the cylinder #3, the routine goes into step 35, and in the same manner as described above, the target time of the cylinder #4 of the closest intake stroke and the target times Tatm1 through Tatm3 of the other cylinders are set.

At step 96, it is judged whether or not the present reference angle signal REF corresponds to the ignition reference position of the cylinder #4, and when it is judged that the reference angle signal REF corresponds to the ignition reference position of the cylinder #4, the routine goes into step 97 and Tatm2 is set at $\frac{1}{2}TREF$. With respect to the other cylinders, the setting coping with the delay of 180° is performed. When it is judged that the reference angle signal REF does not correspond to the cylinder #4, the routine goes into step 98, and Tatm1 is set at $\frac{1}{2}TREF$.

As is apparent from the foregoing description, the target times Tatm1 through Tatm3 are renewed and set as the times up to the target times of the fuel setting for the respective cylinders based on the newest TREF (engine revolution number N) every time the reference angle signal REF is emitted from the crank angle sensor 15. Accordingly, the target time of one cylinder rises as the time from the first emission of the reference angle signal REF for driving the engine to the next intake BDC, and then, the target time decreases at intervals of 1 millisecond with the lapse of time. When the reference signal REF is emitted again, the increase or decrease correction is carried out according to the engine revolution number N and the target time becomes zero at intake BDC of said cylinder.

If the target times Tatm1 through Tatm3 are set individually for the respective cylinders in the above mentioned manner, the target times Tatm1 through Tatm3 for the respective cylinders can be read out at any time without being influenced by the engine revolution number N and the like. Accordingly, the corrected supply of fuel can be performed, and the demanded correction quantity can be set very precisely based on the above-mentioned target times Tatm1 through Tatm3.

Figure 9:
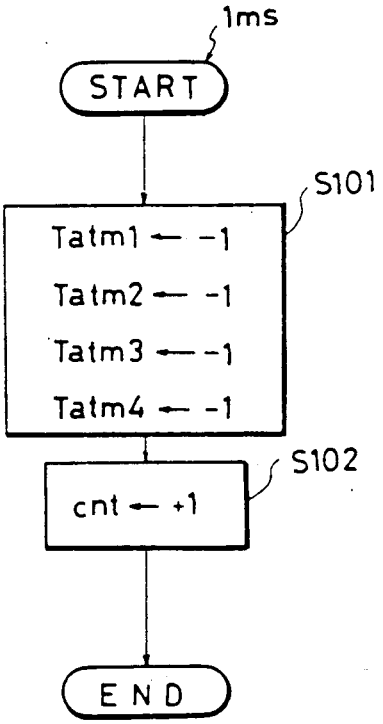

The times Tatm1 through Tatm3 (milliseconds) for the respective cylinders, renewed and set at every emission of the reference angle signal REF according to the routine shown in the flow chart of FIG. 8, are counted down according to the routine shown in FIG. 9.

The routine shown in the flow chart of FIG. 9 is employed at every 1 millisecond, which is the shortest unit of the above-mentioned target times Tatm1 through Tatm3 (milliseconds). At step 101, values obtained by subtracting 1 millisecond from Tatm1 through Tatm3 are set, so that every time the present routine is employed, the target times Tatm1 through Tatm3 (milliseconds) decrease by 1 millisecond, and the times from the point of the emission of the reference angle signal REF to the point when the target times Tatm1 through Tatm3 (milliseconds) decrease to the target values are shown in succession.

If every reference angle signal REF is renewed and set based on the newest engine revolution number N according to the routine shown in the flow chart of FIG. 8 as described above and Tatm1 through Tatm3 which decrease 1 millisecond by millisecond and show the times from the present point to the target times for setting the injection of fuel for the respective cylinders are used for computing and setting the above-mentioned interrupt injection quantities y11 through y44 and normal injection correction quantities y1 through y4, the correction control of the supply of the fuel coping with the response delay of the fuel control at the transient driving state of the engine can be performed very precisely for each cylinder.

At step 102, the count value cnt (free-run counter) is increased by 1, and this count value cnt is set at cntold at the time Tiend of the termination of the normal injection (when the driving pulse signal is turned off) and the above-mentioned cntold is compared with the newest count value cnt at step 22 and it is judged whether or not the state is just after the normal fuel injection.

As is apparent from the foregoing description, according to the present embodiment, the response delays in the control of the fuel supply at the transient driving state are estimated and set independently for the respective cylinders based on the change quantity of the basic fuel injection quantity Tpqcyl (engine load parameter) set based on the opening area A and engine revolution number N and the times Tatm1 through Tatm4 of the present point to the predetermined crank angle positions of the intake strokes of the respective cylinders, and at the first acceleration, the shortage of fuel in the late intake stroke is prevented by the interrupt injection (the control of the additional fuel supply) and reduction of the concentration of the air-fuel ratio at the initial stage of acceleration is prevented, while when the transient driving state is continued, the fuel injection quantities Ti at the normal sequential injection are corrected according to the above-mentioned estimated response delays individually for the respective cylinders (correction control of the normal fuel injection). Acccordingly, at the time of the acceleration (including the slot, acceleration), reduction of the air-fuel ratio control characteristics can be prevented with a great deal of precision individually for the respective cylinders.

Furthermore, in carrying out the above-mentioned correction control of the above-mentioned response delay, the transient driving state need not be particularly divided into the acceleration state and the stationary state, and the present data of the times Tatm1 through Tatm4 can be directly used irrespective of acceleration or deceleration or of the interrupt injection or normal fuel injection. Accordingly, reduction of the concentration of the air-fuel mixture at the initial stage of acceleration and response delay in the normal fuel supply at acceleration can be coped with and corrected by simple control software.

In the present embodiment, the basic fuel injection quantity Tppb in the normal sequential injection control is computed based on the intake pressure PB detected by the intake pressure sensor 9. However, there can be adopted a structure in which, an air flow meter of the hot wire type for detecting the intake air flow quantity Q is disposed instead of the intake pressure sensor 9 and the, basic fuel injection quantity is computed based on the intake air flow quantity Q.

I claim:

1. A method for controlling a supply of fuel to an internal combustion engine which is constructed so that a fuel supply quantity is based on a driving state of said internal combustion engine and fuel supply means disposed for respective cylinders are independently actuated at times matched to intake strokes of said respective cylinders based on said fuel supply quantity to supply said fuel to said respective cylinders, said method comprising:

computing a time up to a target crank angle position for each cylinder of said cylinders;

setting a quantity of correction of said fuel supply quantity based on said time computed for said each cylinder and a ratio of change of an engine load parameter; and causing said fuel supply means disposed for said respective cylinders to perform correction operations based on said quantity of correction.

2. A method for controlling a supply of fuel to an internal combustion engine according to claim 1, wherein engine load parameter is set based on a variable controlled open area of an intake path system of said engine and a revolution number of said engine.

3. A method for controlling a supply of fuel to an internal combustion engine according to claim 1, wherein said correction operations of said fuel supply means disposed for said respective cylinders, based on said quantity of correction of said fuel supply quantity, are performed by correcting a fuel supply control performed at times matches to intake strokes of said respective cylinders.

4. A method for controlling a supply of fuel to an internal combustion engine according to claim 1, wherein said fuel supply means for said respective cylinders are actuated to perform said correction operations based on said quantity of correction of said fuel supply quantity, independently from a fuel supply control conducted at times matched to an intake stroke in said each cylinder.

5. A method for controlling a supply of fuel to an internal combustion engine according to claim 1, wherein said time up to said target crank angle position in said intake stroke is renewed and set based on a revolution number of said engine and a crank angle to said target crank angle position every time said engine revolution number is renewed.

6. A method for controlling a supply of fuel to an internal combustion engine according to claim 1, wherein said target crank angle position is set in a range from a point of 90° after a top dead point of intake to a bottom dead point of intake.

7. A method for controlling a supply of fuel to an internal combustion engine according to claim 1, wherein in a state of acceleration just after control for stopping said supply of said fuel, said ratio of said change of said engine load parameter is increase-controlled according to engine temperature.

8. An apparatus for controlling a supply of fuel to an internal combustion engine, which comprises:

fuel supply quantity determining means for determining a fuel supply quantity based on an engine driving state including at least a state of intake air, which is included in an intake air quantity of said engine detected by engine driving state detecting means;

sequential fuel supply control means for independently actuating fuel supply means disposed for respective cylinders at predetermined supply initiating times based on said fuel supply quantity to perform normal fuel supply at times matched to intake strokes of said respective cylinders;

engine load parameter setting means for setting a parameter relative to an engine load based on a variable controlled opening area of an intake path system of said engine and a revolution number of said engine;

engine load parameter change quantity computing means for computing a quantity of change of an engine load parameter per unit time;

target time computing means for computing target times up to a target crank angle position in an intake stroke individually for said respective cylinders;

correction quantity setting means for setting a quantity of correction of said fuel supply quantity individually for said respective cylinders based on said quantity of change of said engine load parameter and a time set for each cylinder of said respective cylinders by said target time computing means; and corrected fuel supply control means for performing at least one of normal corrected supply control for correcting and setting said supply control means for performing at least one of normal corrected supply control for correcting and setting said fuel supply quantity based on said quantity of correction set for each cylinder of said respective cylinders and causing said sequential fuel supply control means to perform said normal fuel supply while maintaining a corresponding relation to said cylinders and additional supply control for actuating said fuel supply means of a corresponding cylinder based on a corrected quantity for said each cylinder, independently from said sequential fuel supply control means.

9. An apparatus for controlling a supply of fuel to an internal combustion engine according to claim 8, which further comprises:

target time renewal control means for renewing and setting a target time of said target times computed for each said cylinder by said target time computing means, every time said parameter based on said revolution number is renewed, based on a renewed value of said parameter of said revolution number and a crank angle to said target crank angle position for said each cylinder.

10. A method for controlling a supply of a fuel to an internal combustion engine according to claim 8, wherein said target crank angle position which is a target of time computation by said target time computing means for said each cylinder is set in a range from a point of 90° after a top dead point of intake to a bottom dead point of intake.

11. An apparatus for controlling a supply of fuel to an internal combustion engine according to claim 8, wherein in said additional correction quantity set for said each cylinder by said correction quantity setting means is correct and set based on engine temperature.

12. An apparatus for controlling a supply of fuel to an internal combustion engine according to claim 8, wherein in said additional supply control by said corrected fuel supply means, when a time longer than a predetermined time has passed from a point of termination of control of operation of said fuel supply means by said sequential fuel supply control means, said correction quantity setting means is corrected and set based on response delay of said fuel supply means.

13. An apparatus for controlling a supply of fuel to an internal combustion engine according to claim 8, wherein said engine load parameter setting means sets a basic fuel supply quantity as said parameter relative to said engine load.

14. An apparatus for controlling a supply of fuel to an internal combustion engine according to claim 8, wherein said normal supply correction control by said corrected fuel supply control means is a control for correcting a basic fuel supply quantity in said fuel supply quantity set by said fuel supply quantity setting means.

15. An apparatus for controlling a supply of fuel to an internal combustion engine according to claim 8, wherein said engine load parameter change quantity computing means increase-corrects said change quantity of said engine load parameter according to engine temperature in an acceleration state just after control of stopping said supply of said fuel.

* * * * *